US007044145B2

(12) United States Patent
Bouchard

(10) Patent No.: US 7,044,145 B2
(45) Date of Patent: May 16, 2006

(54) MOBILE SHELTER COMPRISING AN UMBRELLA-LIKE COLLAPSIBLE MARQUEE

(76) Inventor: Paul-André Bouchard, 1562, Van Horne, Outremont, Québec (CA) H2V 1L5

( * ) Notice: Subject to any disclaimer, the term of this patent is extended or adjusted under 35 U.S.C. 154(b) by 0 days.

(21) Appl. No.: 11/085,469

(22) Filed: Mar. 22, 2005

(65) Prior Publication Data

US 2005/0178616 A1 Aug. 18, 2005

Related U.S. Application Data

(63) Continuation of application No. PCT/CA2003/001480, filed on Sep. 26, 2003.

(30) Foreign Application Priority Data

Sep. 30, 2002 (CA) ..... 2405007

(51) Int. Cl.
*E04H 15/28* (2006.01)
*E04H 15/06* (2006.01)
*E04H 1/12* (2006.01)

(52) U.S. Cl. ..... 135/98; 135/16; 135/912; 135/88.01; 52/143

(58) Field of Classification Search ..... 135/98, 135/16, 20.1, 21, 132, 135, 912, 88.01, 88.13; 52/83, 143; 296/102, 105
See application file for complete search history.

(56) References Cited

U.S. PATENT DOCUMENTS 2,950,727 A 8/1960 Dunn (Continued)

FOREIGN PATENT DOCUMENTS

CA 2019415 10/1995

(Continued)

*Primary Examiner*—Hugh B. Thompson, II
(74) *Attorney, Agent, or Firm*—F. Matineau

(57) ABSTRACT

A mobile shelter comprising a vehicle, a post pivotally attached to the vehicle at one end, and releasably attached at the other end to an umbrella-like collapsible marquee. The marquee comprises a frame, whereby the marquee is attached to the post, a number of articulated brace assemblies pivotally connected to the frame, each brace assembly comprising a number of pivotally interconnected braces. The brace assemblies define a ground-resting end, and a pivot joint pivotally attached to a spreader ring, which in turn slidably engages the post. Upon sliding the spreader ring up and down about the post, the brace assemblies can be shifted between:

a storage position, in which the brace assemblies are collapsed against the post and the ground-resting ends of the brace assemblies are located at the vicinity of the post; and a deployed position, in which the brace assemblies are deployed away from the post, the ground-resting ends of the brace assemblies are spaced-apart from the post and rest on the ground, and in which the spreader ring is releasably attached to the frame.

To install the marquee, the post is pivoted away from the vehicle into a vertical stance, and the spreader ring is slid upwardly about the post, in order to shift the brace assemblies from their storage position to their deployed position, similarly to an umbrella. Then, once the brace assemblies are in their deployed position, the post can be released from the marquee's frame, and the vehicle can be driven away from the marquee with the post.

46 Claims, 10 Drawing Sheets

U.S. PATENT DOCUMENTS

| | | | | |
|---|---|---|---|---|
| 2,986,150 | A | 5/1961 | Torian | |
| 3,240,217 | A | 3/1966 | Bird et al. | |
| 3,953,955 | A | 5/1976 | Huddle | |
| 4,000,750 | A | 1/1977 | Becher | |
| 4,478,234 | A | 10/1984 | Bester | |
| 5,280,801 | A | 1/1994 | Brosman | |
| 5,797,411 | A | 8/1998 | Parker | |
| 5,953,875 | A | 9/1999 | Harkins | |
| 5,957,145 | A * | 9/1999 | Plumer | 135/16 |
| 6,059,351 | A * | 5/2000 | Ehnes | 135/88.01 |
| 6,345,639 | B1 | 2/2002 | Rousselle et al. | |
| 6,354,316 | B1 | 3/2002 | Chen | |
| 6,378,539 | B1 * | 4/2002 | Allee | 135/16 |
| 6,564,513 | B1 | 5/2003 | Henbid et al. | |
| 6,722,380 | B1 * | 4/2004 | Hafer | 135/16 |
| 2002/0092554 | A1 | 7/2002 | Ham et al. | |

FOREIGN PATENT DOCUMENTS

| | | |
|---|---|---|
| CA | 2228270 | 2/1997 |
| CA | 2338439 | 2/2000 |
| DE | 93 13 590.4 | 12/1993 |
| DE | 197 04 105 A1 | 8/1998 |
| GB | 2265165 A * | 9/1993 |

* cited by examiner

MOBILE SHELTER COMPRISING AN UMBRELLA-LIKE COLLAPSIBLE MARQUEE

CROSS-REFERENCE DATA

The present patent application claims the conventional priority under the Paris Convention of co-pending Canadian patent application No. 2,405,007 filed on Sep. 30, 2002 naming the present inventor.

FIELD OF THE INVENTION

The present invention relates to umbrella-like shelters, and more particularly to a mobile shelter comprising an umbrella-like collapsible marquee.

BACKGROUND OF THE INVENTION

It is known to install collapsible marquees on outdoor lots for hosting outdoor events therein, for example entertainment events such as circus performances and concerts. Such marquees are vast enough to accommodate the stage area for the performance act as well as a large audience, and can thus be very large and tall, e.g. they can have a diameter of 40 meters and a height of 12 meters. To erect such marquees, several workers are required to piece together poles, canvas, cables and ropes, and other components, and are often required to do so while standing on the narrow rungs of a ladder. This assembling procedure is a fastidious and lengthy process which can involve two or three full days of labour for these several workers, and can further be hazardous for the workers as they may be injured during the installation process.

Some small-scale existing shelters, such as tents or the like, comprise an umbrella-like collapsible framework, which is known for its quick and simplified erection process. This sort of framework can be easily and rapidly collapsed, and put into a compacted transport configuration. Umbrella-like shelter frameworks generally comprise a number of legs, composed of a number of pivotally interconnected rods, and further comprise a post, along which a hollow sleeve can be axially slid. To expand the shelter, the sleeve is slid upwardly along the post, in an analogous manner than for an umbrella, until the legs are completely deployed. Similarly, to collapse the shelter, the sleeve is slid downwardly along the post until the legs are completely retracted.

However, these shelters are small, and are not intended to be constructed at an enlarged scale. Indeed, their structure is too weak, and their internal mechanisms are not intended to be transposed to marquees of greater capacity. Therefore, a need exists for easy to transport, easy to deploy collapsible marquees of large capacity, for example of the type being able to contain up to 2000 persons.

SUMMARY OF THE INVENTION

The present invention relates to a mobile shelter comprising:

a vehicle;

an umbrella-like collapsible marquee comprising:

a frame;

a number of articulated brace assemblies each comprising a number of pivotally interconnected braces, and defining a ground-resting end, a first pivot joint pivotally attached to said frame and a second pivot joint pivotally attached to a spreader member; and a canvas, carried by said articulated brace assemblies; and a post having a first end portion releasably attachable to said frame and a second end portion carried by said vehicle;

wherein said articulated brace assemblies are movable between:

a first storage position, in which said brace assemblies are collapsed against said post, said ground-resting ends of said brace assemblies are located at the vicinity of said post, and in which said spreader member engages said post away from said first end portion of said post; and a second deployed position, in which said brace assemblies are deployed away from said post, to define a canvas-sheltered opened usable area, said ground-resting ends of said brace assemblies are spaced-apart from said post, and in which said spreader member is releasably attached to said frame;

wherein said spreader member movably engages and is guided along said post when said brace assemblies are moved between said first storage position said second deployed position, and wherein when said brace assemblies are in said deployed position, said post first end portion can be released from said frame, and said vehicle can be moved away from said marquee with said post to clear said canvas-sheltered usable area.

In one embodiment, an actuator is provided on said marquee, which can be activated to forcibly drive said spreader member along said post.

In one embodiment, said actuator comprises a hoisting system carried by said post, and a pushing member operatively connected to said hoisting system and slidably engaging said post; said spreader member is located intermediate said pushing member and said frame when said spreader member engages said post, and upon activation of said hoisting system, said pushing member will be forcibly driven along said post to slidably carry said spreader member.

In one embodiment, when said spreader member engages said post, said spreader member is releasably attached to said pushing member.

In one embodiment, said post is attached to said vehicle through the instrumentality of a post attachment base which comprises an elongated socket and a post lifting mechanism, said post second end portion slidably engaging said socket, with said post lifting mechanism allowing said post second end to be moved along and within said socket between inner and outer limit positions.

In one embodiment, said post attachment base is pivotally attached to said vehicle, said post attachment base thereby pivotally connecting said post to said vehicle to allow said post to be moved between a first position in which said post lies substantially parallel to said vehicle, and a second limit position in which said post is upstanding within said vehicle.

In one embodiment, each said brace assembly comprises:

a frame connecting brace defining a first end pivotally connected to said marquee frame and a second end opposite said first end;

a spreader brace defining a first end pivotally connected to said spreader member and a second end opposite said first end, with said second end of said frame connecting brace being pivotally attached to said spreader member intermediate said spreader brace first and second ends;

a ground-resting brace having a first end destined to rest on the ground in said deployed position of said brace assembly and a second end opposite said first end, with said second end of said spreader brace being pivotally attached to said ground-resting brace intermediate said ground-resting brace first and second ends; and an intermediate brace having a first end pivotally connected to said frame connecting brace first and second ends, and a second end opposite said first end and pivotally connected to said ground-resting brace second end.

In one embodiment, during the movement of said brace assemblies from said first storage position to said second deployed position, said ground-resting end of said brace assemblies will describe a pseudo-parabolic trajectory, and said brace assemblies will avoid said vehicle.

In one embodiment, said vehicle is a trailer.

The present invention also relates to a mobile shelter comprising:

a vehicle;

an umbrella-like collapsible marquee comprising:

a frame;

a number of articulated brace assemblies each comprising a number of pivotally interconnected braces, and defining a ground-resting end, a first pivot joint pivotally attached to said frame and a second pivot joint pivotally attached to a spreader member; and a canvas, carried by said articulated brace assemblies; and a post having a first coupling member attachable to said frame, and a second coupling member attachable to said vehicle, at least one of said first coupling member and said second coupling member being a releasable attachment joint;

wherein said articulated brace assemblies are movable between:

a first storage position, in which said brace assemblies are collapsed against said post, said ground-resting ends of said brace assemblies are located at the vicinity of said post, and in which said spreader member engages said post away from said first end portion of said post; and a second deployed position, in which said brace assemblies are deployed away from said post, to define a canvas-sheltered opened usable area, said ground-resting ends of said brace assemblies are spaced-apart from said post, and in which said spreader member is releasably attached to said frame; wherein said spreader member movably engages and is guided along said post when said brace assemblies are moved between said first storage position said second deployed position, and wherein when said brace assemblies are in said deployed position, said post can be moved away from said opened usable area.

In one embodiment, said post second coupling member is releasable, said post being thereby releasably attached to said vehicle, and said first coupling member is pivotable, said post being thereby pivotally attached to said frame; and when said brace assemblies are in said deployed position, said post can be released from said vehicle, said vehicle can be driven away from said marquee, and said post can be pivoted about said first post coupling member into a stored position adjacent at least one of said brace assemblies to clear said canvas-sheltered usable area.

In one embodiment, said post first coupling member is releasable, said post being thereby releasably attached to said frame; and when said brace assemblies are in said deployed position, said post can be released from said frame, and said vehicle can be driven away with said post from said marquee to clear said canvas-sheltered usable area.

DETAILED DESCRIPTION OF THE EMBODIMENTS

Figure 1:
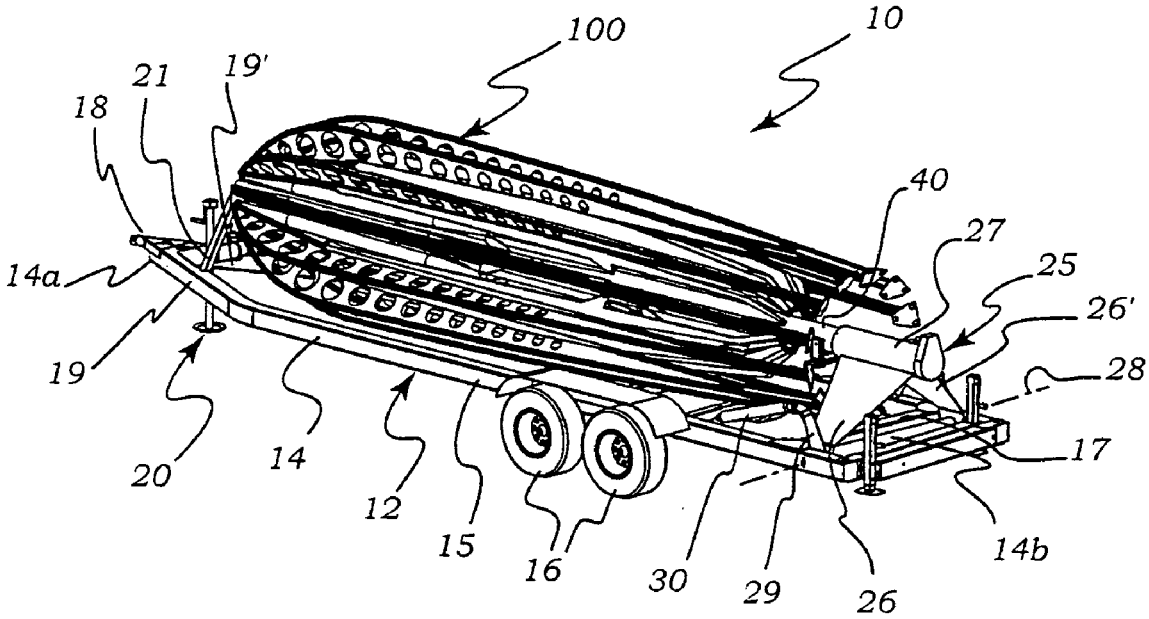
FIG. 1 shows a front perspective view of a mobile shelter according the present invention comprising a trailer-carried umbrella-like collapsible marquee, the marquee being set in its storage configuration, with the marquee's canvas being removed for clarity of the drawing.

FIG. 1 shows a mobile shelter 10 according to the present invention. Shelter 10 comprises a vehicle 12, a marquee-carrying post 40 pivotally mounted onto trailer 12, and an umbrella-like collapsible marquee 100 releasably attached to post 40, as described hereinafter.

Figure 2:
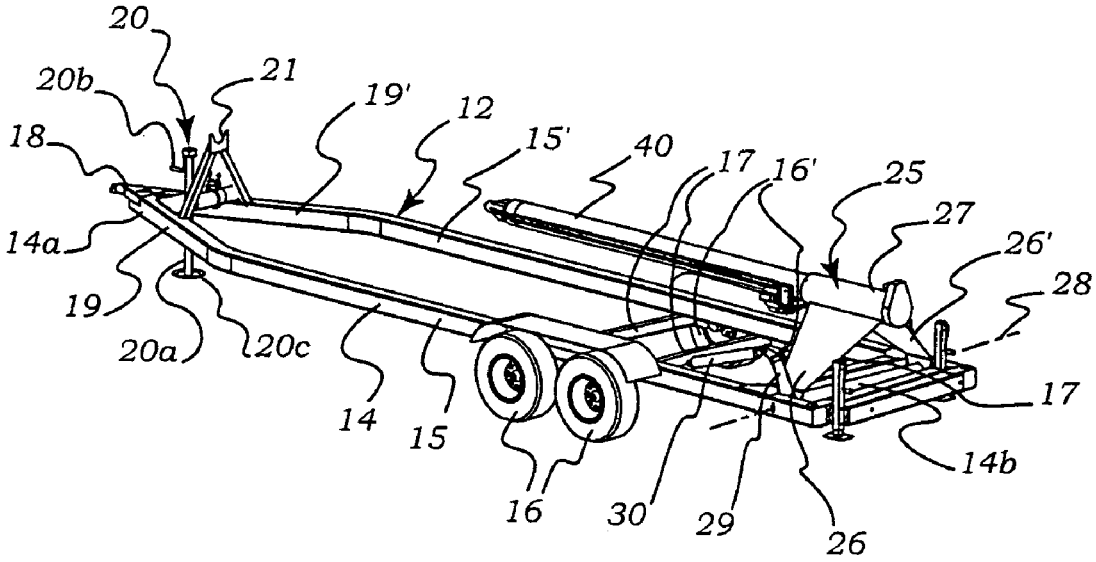
FIG. 2 shows a front perspective view of the trailer and post of the mobile shelter of FIG. 1.
Figure 3:
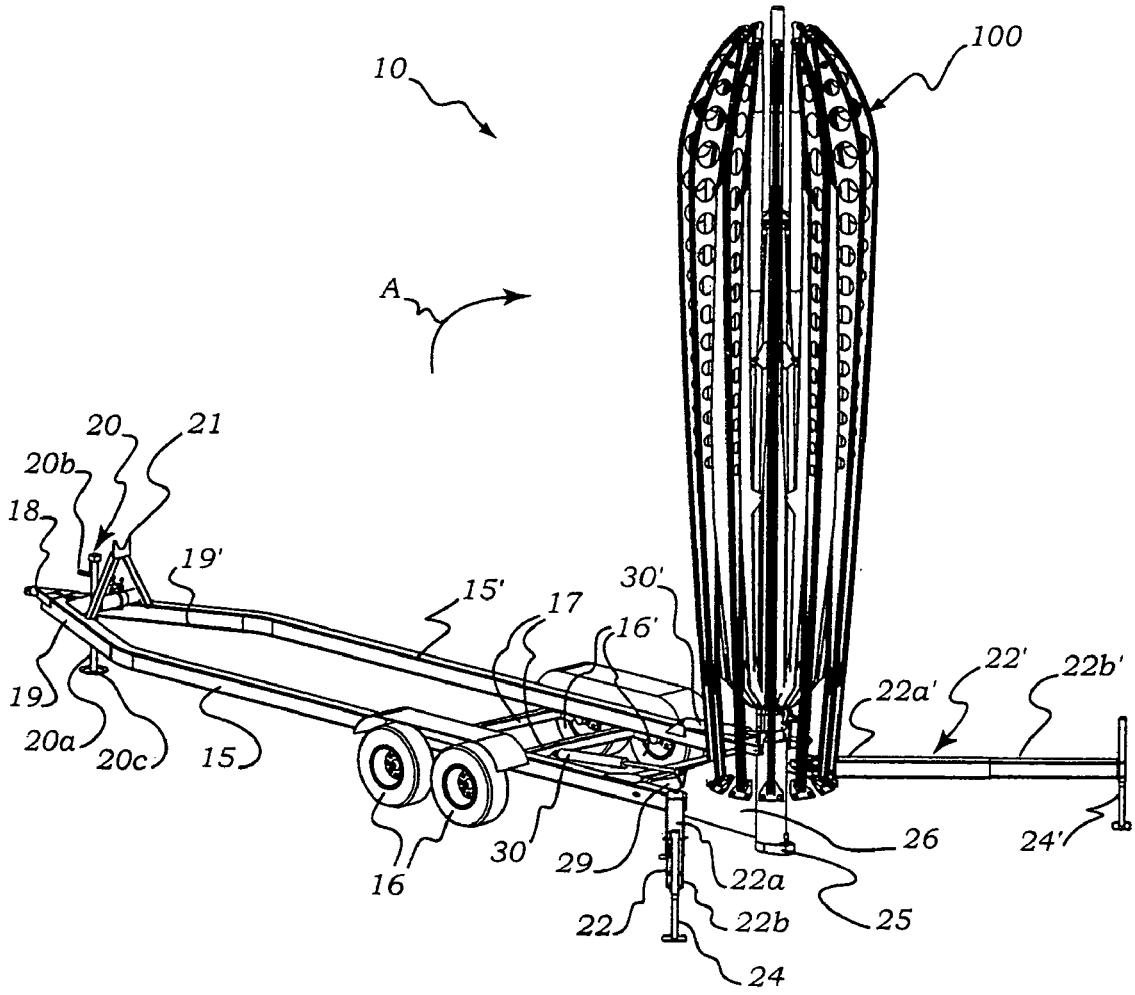
FIG. 3 shows a front perspective view of the mobile shelter of FIG. 1, with the marquee being pivoted relative to the trailer in an vertical stance.

Vehicle 12 can be any kind of vehicle, motorized or not, sturdy enough to bear the added weight of post 40 and marquee 100. In the embodiment shown in the appended figures, vehicle 12 is a trailer, and will further be referred to as trailer 12 in the present specification. As shown in FIGS. 1–3, trailer 12 comprises a chassis 14 defining a front end 14*a* and an opposite rear end 14*b*. Chassis 14 comprises two parallelely spaced-apart beams 15, 15', and three crossbars 17 extending transversely between and fixedly attached to beams 15 and 15'. Two pairs of wheels 16 and 16' are rotatably attached to the rear portion of beams 15 and 15' respectively, at the vicinity of chassis rear end 14*b*. At the vicinity of chassis front end 14*a*, two tow bars 19, 19' extend from beams 15, 15' respectively in an elbowed fashion, in order to converge towards and intersect with each other. At their intersection, a tow hitch 18 is fixedly installed, which will allow trailer 12 to be releasably attached to and towed by a motorized vehicle (not shown), e.g. a car or a truck.

Furthermore, a front marquee support member 21 is fixedly attached to tow bars 19, 19', close to chassis front end 14*a*.

A telescopic support leg 20 is attached to the front end of chassis 14; support leg 20 comprises a tubular sleeve 20*a*, a crank 20*b* attached to the top end of sleeve 20*a*, and a sand shoe 20*c* attached to a rod (not shown) which slidably engages the inner cavity of tubular sleeve 20*a* from its bottom end. Sand shoe 20*c* can be slidably extracted out or retracted in sleeve 20*a*, by appropriately handling crank 20*b*.

Two extendable arms 22, 22' are pivotally attached to the end of beams 15, 15' adjacent chassis rear end 14*b*, and can pivot relative to chassis 14 about a vertical pivot axis (not shown). Each one of arms 22, 22' comprises a tubular sleeve portion 22*a*, 22*a*', and a sliding rod portion 22*b*, 22*b*' engaging the inner cavity of tubular sleeve portion 22*a*, 22*a*'. To adjust the overall length of each of arms 22, 22', rod portion 22*b*, 22*b*' can be selectively slid in and out of sleeve portion 22*a*, 22*a*'. Furthermore, telescopic support legs 24, 24' are perpendicularly fixedly attached to the free end of rod portions 22*b*, 22*b*'.

Arms 22, 22' and support legs 24, 24', in cooperation with support leg 20, will ensure that trailer 12 will stably rest on when support legs 20, 24, 24' engage the ground.

As illustrated in FIGS. 1–3, trailer 12 is further provided with a post attachment base 25. Post base 25 is pivotally attached to chassis 14, adjacent chassis rear rend 14*b*, and can pivot about a horizontal pivot axis 28. Post base 25 comprises two converging side attachment flanges 26, 26' pivotally attached to beams 15, 15' adjacent chassis rear end 14*b*. Post base 25 also comprises a post lifting mechanism 27, integrally attached to the end of flanges 26, 26' opposite their attachment to beams 15, 15'; a more elaborate description of lifting mechanism 27 will be set forth in hereinafter.

Two pivot levers 29 are attached to flanges 26, 26', at the vicinity of pivot axis 28, with only one pivot lever 29 being revealed in the drawings (the other pivot lever being concealed behind flange 26' in FIGS. 1–2). The free end of pivot levers 29 is attached to one end of a corresponding one of hydraulic cylinders 30, 30'; the other end of cylinders 30, 30' is pivotally attached to the innermost face of beams 15, 15', at the vicinity of chassis rear end 14*b*. Cylinders 30, 30' will provide mechanical assistance in pivoting post base 25 about pivot axis 28 between two limit positions: a horizontal limit position where cylinders 30, 30' are retracted, and where lifting mechanism 27 is horizontally arranged above chassis 14 (as illustrated in FIG. 1), and a vertical limit position where cylinders 30, 30' are extracted, and where lifting mechanism 27 is vertically disposed beyond the rear end of beams 15, 15', as illustrated in FIG. 3.

Figure 4:
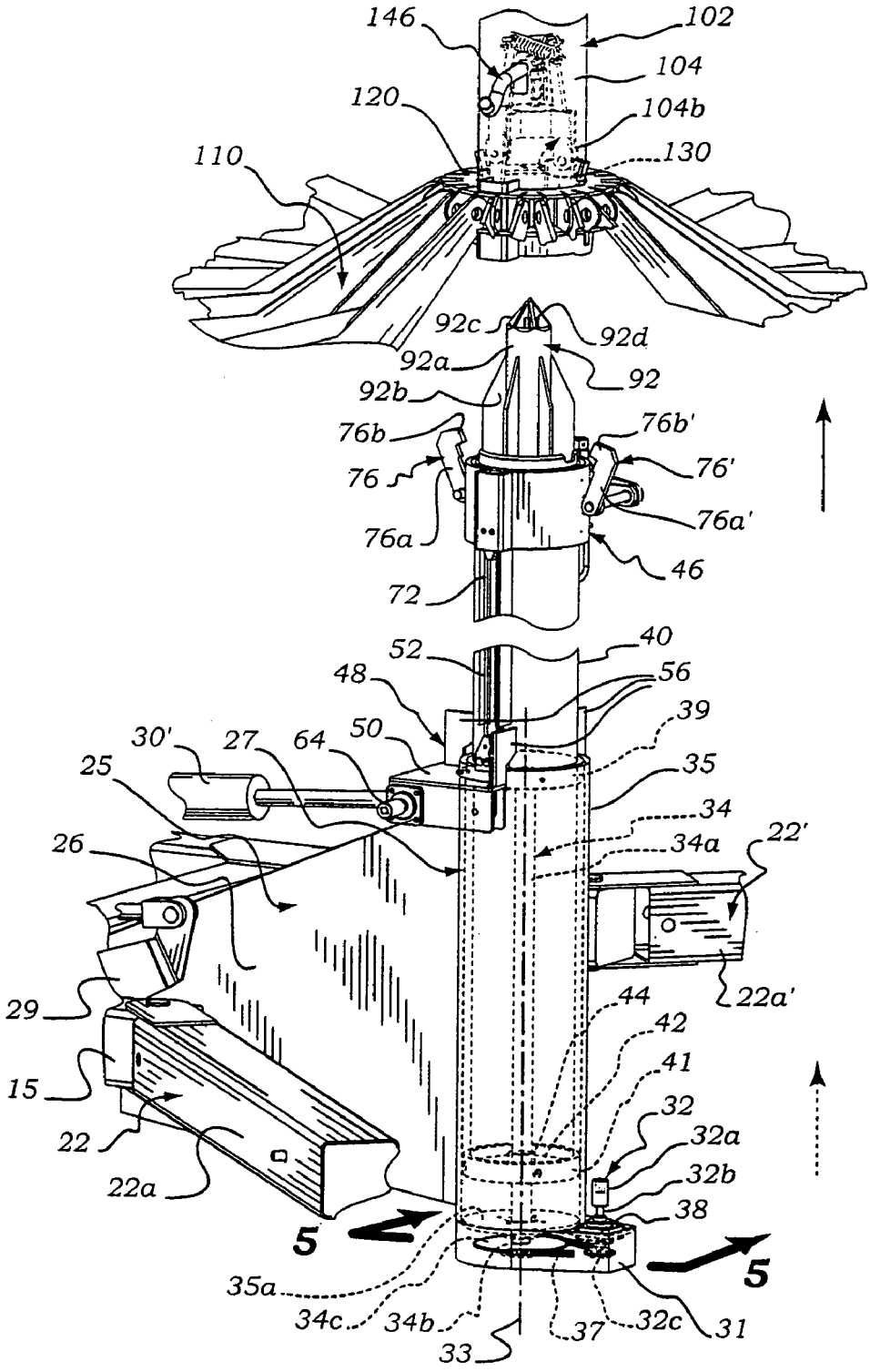
FIG. 4 shows an enlarged partial perspective view of the shelter of FIG. 3, focusing on the post of the marquee.
Figure 5:
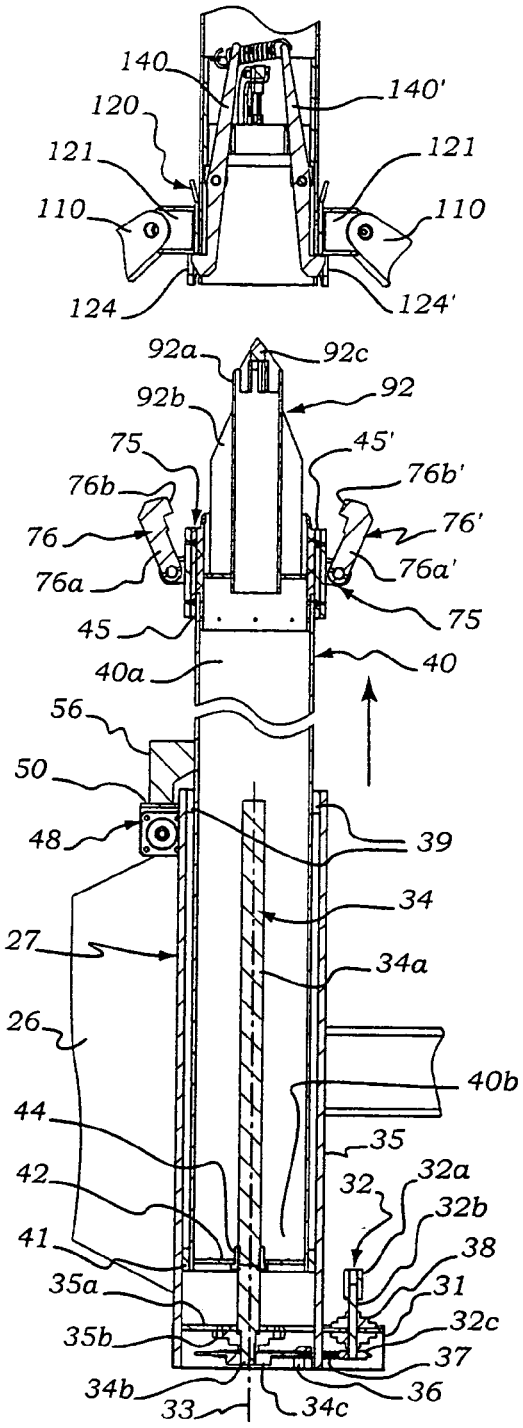
FIG. 5 shows a partial cross-sectional view of the shelter taken along lines 5—5 of FIG. 4.
Figure 6:
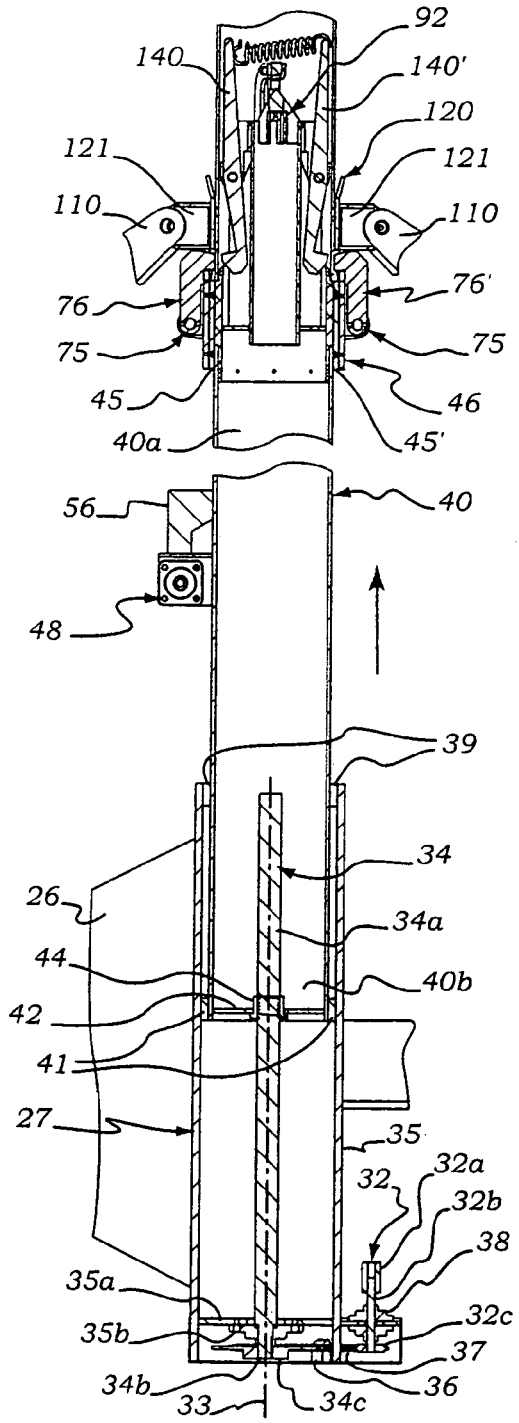
FIG. 6 is similar to FIG. 5, but with the top portion of the post engaging the trunk member of the marquee's frame.

As illustrated in FIG. 4–6, post lifting mechanism 27 defines a longitudinal axis 33, and comprises an elongated cylindrical socket 35 and a flat hollow lip 31 attached to and protruding horizontally from the bottom end of socket 35. Socket 35 comprises an inner discoid plate 35*a* having an aperture at its center, inner plate 35*a* being slightly upwardly offset from the bottom end of socket 35 and peripherally fixedly attached to the inner wall of socket 35; a bearing 35*b* is mounted in the central aperture of inner plate 35*a*. An endless lifting screw 34, defining a threaded shank 34*a* and a pivot pin portion 34*b* integrally extending from the bottom end of shank 34*a*, is pivotally installed in socket 35; shank 34*a* is dimensioned to extend between inner plate 35*a* and the top edge of socket 35. Pivot pin portion 34*b* is journalled to and extends downwardly through and beyond bearing 35*b*. Endless screw 34 can thus be rotated about its rotary engagement in bearing 35*b*, about a longitudinal axis 33. Moreover, a sprocket wheel 34*c* is fixedly mounted at the bottom end of pivot pin portion 34*b*. Socket 35 is also provided with a side aperture 36 located beneath support plate 35, and registering with the inner hollow of lip 31.

A through-hole is made in the top face of lip 31, around which is mounted a bearing 38. Lip 31 comprises a drill adaptor 32, which in turn comprises a drill socket 32*a* destined to receive a compatible drill bit therein (not shown), and fixedly attached to the top end of a shaft 32*b*. Shaft 32*b* is journalled to and extends downwardly beyond bearing 38; drill adaptor 32 is thus rotatably mounted onto and extends outwardly over lip 31. In addition, a sprocket wheel 32*c* is centrically attached to the lower end of shaft 32*b*.

Sprocket wheel 32*c* is mechanically coupled to sprocket wheel 34*c* through the instrumentality of an endless chain 37, which runs from sprocket wheel 34*c* to 32*c* through aperture 36. Upon rotation of drill adaptor 32, torque will be transmitted from sprocket wheel 32*c* to sprocket wheel 34*c* through chain 37, and endless screw 34 will be rotated due to its rotary engagement to bearing 35*b*, about longitudinal axis 33.

Elongated post 40, as presented hereinabove, defines a top end portion 40*a*, a bottom end portion 40*b*, and a longitudinal axis centrically extending along post 40 between end portions 40*a* and 40*b*. Post 40 is made of a sturdy material, for example machined aluminium or stainless steel. Post 40 comprises a discoid bottom plate 42 fixedly attached to the bottom end of post 40, and a cylindrical tubular collar 44 centrically extending through plate 42, collar 44 having a threaded inner wall. Post bottom end portion 40*b* slidably engages socket 35 of lifting mechanism 27, in order for the longitudinal axis of post 40 to coincide with socket longitudinal axis 33. More particularly, shank 34*a* of screw 34 threadingly engages collar 44; upon rotary motion of endless screw 34, the threads of shank 34*a* and that of collar 44 will cooperate together to displace post 40 axially along longitudinal axis 33, in and out of socket 35 of lifting mechanism 27, although post 40 will not rotate. To ease the sliding axial displacement of post end portion 40*b* about socket 35, two bushings 39 and 41 are installed between the inner peripheral wall of socket 35 and the outer peripheral wall of post 40*b*; bushing 41 is firmly and fixedly attached to the bottom end of post 40, and bushing 39 is firmly and fixedly attached to the inner wall of socket 35 adjacent the top rim thereof. Rings 39, 41 can be made of a low-friction material, such as PTFE (polytetrafluoroethylene, or Teflon®). Bushings 39, 41, in addition to allowing low-friction displacement of post 40 about socket 35, also serve as anti-egress means for preventing an accidental disengagement of post 40 from socket 35. Indeed, as post 40 is axially driven out of socket 35, bushing 41 will eventually abut on bushing 39, and post 40 can thereby be prevented from further egress out of socket 35. Post 40 is therefore axially movable between a bottom limit position in which the post bottom plate 42 downwardly abuts against the socket inner plate 35*a*, and an upper limit position in which the post lower bushing 41 abuts against upper bushing 39 that is fixedly attached to the socket inner wall.

A marquee engaging fixture 92 engages and is secured to the inner peripheral wall of post top end portion 40*a*. Fixture 92 comprises a cylindrical main body 92*a*, and a circular array of ribs 92*b* integrally and radially protruding from main body 92*a*. A circular array of blades 92*c* integrally upwardly protrude from the top end of fixture 92, as can be seen in the enlarged view of FIG. 10, and converge to a single point (the pointy tip of fixture 92); blades 92*c* are provided with a step-shaped indentation 92*d*. Fixture 92 will allow for umbrella-like collapsible marquee 100 to be releasably attached to post 40, as described hereinafter.

Figure 7:
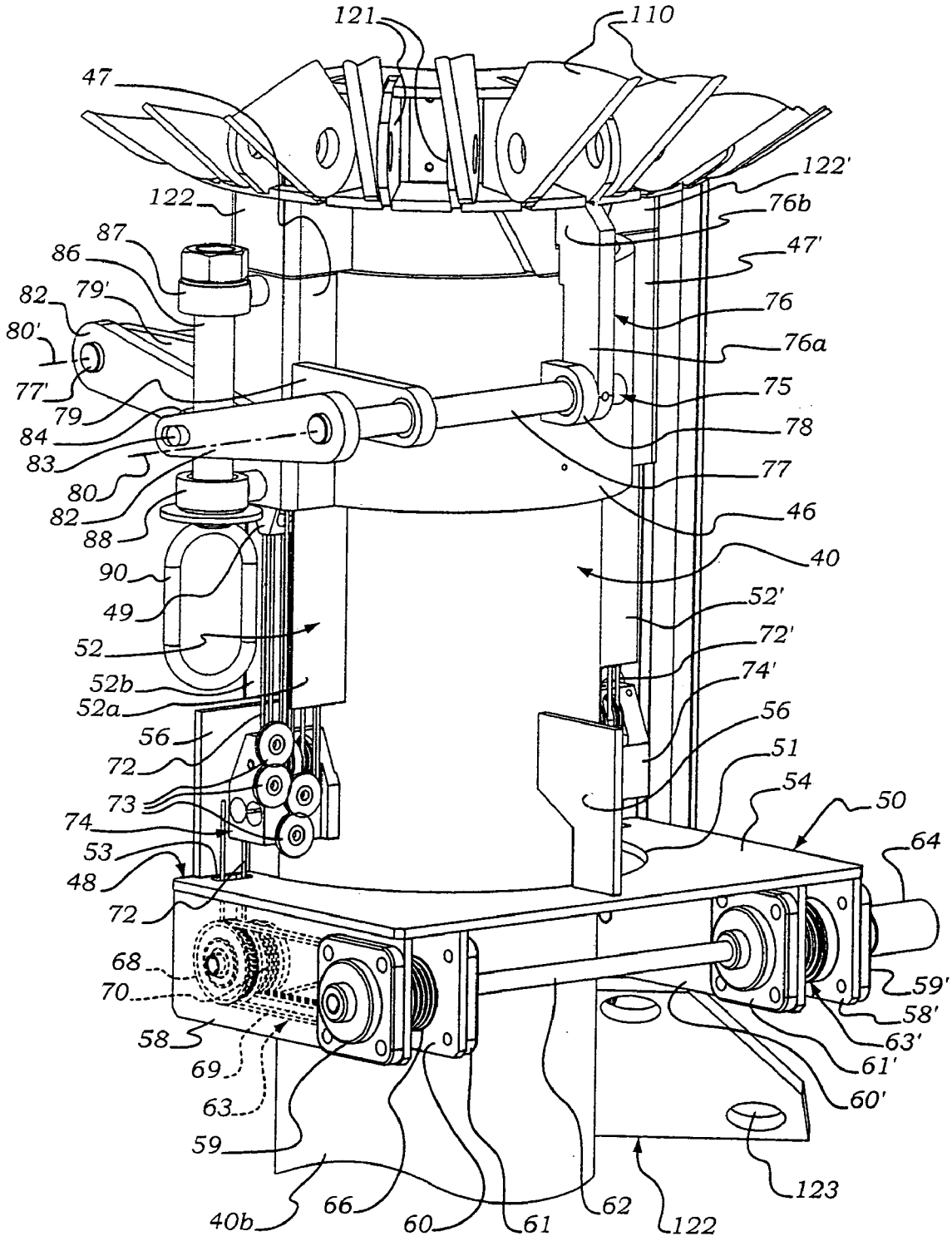
FIG. 7 is a close-up front perspective view of the hoisting system and of the push-ring both mounted on the post of the marquee.

As illustrated in FIG. 7, post 40 is provided with two elongated tracks 52, 52' extending along post 40; tracks 52 and 52' are parallel to longitudinal axis 33, and are disposed at diametrically opposite locations on post 40. Each track 52, 52', for example track 52, comprises two parallel spaced-apart elongated flanges 52*a*, 52*b*, fixedly attached to post 40.

As shown in FIGS. 4–7 and 11–13, a push-ring 46 is coaxially slidably mounted on post 40. Two elongated parallelepiped bushings 45, 45' are screwed to the inner wall of push-ring 46, at diametrically opposite locations thereon and between tracks 52, 52' (as shown in FIGS. 5–6 and 11–12). Bushings 45, 45' are made of a low-friction material, such as PTFE. Push-ring 46 also has two lateral cross-sectionally U-shaped guiding grooves 47, 47' located at diametrically opposite locations on ring 46 spacedly from bushings 45, 45'. Grooves 47, 47' are sized to accommodate tracks 52, 52' therein, and will guide the sliding displacement of push-ring 46 along post 40, by remaining engaged on and sliding along tracks 52, 52'. A cable guide 49 (partly apparent only in FIG. 7) is nested within each one of grooves 47, 47'. Only the cable guide nested inside groove 47 is apparent in the appended drawings; the opposite cable guide is concealed under groove 47' in FIG. 7. The purpose of cable guide 49 will be described hereinafter.

To deploy marquee 100, push-ring 46 will have to be driven up and down along post 40, either towards top end portion 40*a*, or towards bottom end portion 40*b* (as described hereinafter). Mechanical assistance is provided on marquee 100 to forcibly drive push-ring 46 up and down about post 40: a push-ring actuating or hoisting system 48, installed on post 40, and operatively connected to push-ring 46. Push-ring hoisting system 48 (FIG. 7) has a hoisting base 50 that comprises a top plate 54 defining a semi-circular indentation 51 therein, and three L-shaped brackets 56 in turn fixedly attached at one end to top plate 54, and at the other end to post 40. Brackets 56 define flat horizontal top edges that are horizontally coplanar. Brackets 56 are attached in such a way to both plate 54 and post 40 to allow a gap between indentation 51 and post 40. In some positions of post 40 relative to socket 35, the top rim portion of socket 35 will engage this gap between post 40 and plate 54 of hoisting base 50 (as illustrated in FIG. 5 for example). Furthermore, apart from suitably supporting hoisting base 50 spacedly from post 40, brackets 56 also serve as stops for push-ring 46; indeed, push-ring 46 cannot slide downwardly along post 40 beyond brackets 46, as it will eventually abut against and be stopped by the flat horizontal top edge of brackets 56.

On the bottom surface of top plate 54 of hoisting base 50, two lateral plates 58, 58' and two intermediate plates 60, 60' are fixedly and perpendicularly installed. A shaft 62 rotatably extends transversely and successively through bearings 59, 59', 61, 61' carried by plates 58, 58', 60, 60' adjacent the edge of top plate 54 opposite indentation 51. A drill socket 64 similar to drill socket 32*a* of drill adaptor 32 is operatively connected to the end of shaft 62 journalled to and extending through bearing 59' of lateral plate 58'. By selectively rotating drill socket 64, shaft 62 can be also driven into rotary motion.

Hoisting system 48 comprises a first sprocket mechanism 63 installed between lateral plate 58 and intermediate plate 60, and can be driven in motion upon rotation of shaft 62. A second similar sprocket mechanism 63', a large portion of which is concealed in FIG. 7, is installed between lateral plate 58' and intermediate plate 60'; second sprocket mechanism 63', which is a mirror image of first sprocket mechanism 63, can also be driven in motion upon rotation of shaft 62, and although only first sprocket mechanism 63 will be detailed herein, it is understood that second sprocket mechanism 63' functions similarly.

First sprocket mechanism 63 comprises a sprocket wheel 66 fixedly attached to shaft 62, between bearings 59 and 61. Another sprocket wheel 68, to which is bound a drum 70, is rotatably attached between lateral plate 58 and intermediate plate 60, adjacent the edge of top plate 54 in which indentation 51 is recessed. Sprocket wheels 66 and 68 are operatively linked together through the instrumentality of an endless chain 69. Thus, when drill socket 64 is spun, shaft 62 is rotated, and so is sprocket wheel 66, and the rotation of sprocket wheel 66 induces a rotation of the assembly of sprocket wheel 68 and drum 70.

One end of a cable 72 is attached to drum 70. Cable 72 extends upwardly through top plate 54 from drum 70, through an aperture 53. Cable 72 runs from drum 70, to a bottom pulley assembly 74 vertically registering with and located beneath track 52, and then runs upwardly to a top pulley assembly (concealed in the drawings) vertically registering with and located above track 52. Cable 72 runs between flanges 52*a*, 52*b* of track 52 a number of times back and forth alternately between pulleys of the top and bottom pulley assemblies, while running intermediately across and being kept untangled by cable guide 49, located in groove 47 of push-ring 46, that simply includes parallel and distinct cable channels for this purpose. The end of cable 72 opposite its attachment to drum 70 is fixedly secured to cable guide 49, with the latter being fixed to push-ring 46.

Upon drill socket 64 being rotated in a first direction, sprocket wheel 68 and drum 70 are rotated, and cable 72 is wound around drum 70. Since cable 72 extends from drum 70, then alternately through the bottom and top pulley assemblies, and finally over the top pulley assembly and down to its attachment to push-ring 46, winding the first end of cable 72 around drum 70 will result in the second end of cable 72, which is attached to push-ring 46, being lifted upwardly along post 40, and consequently hoisting push-ring 46 upwardly slidably along post 40. The two vertically registering pulley assemblies will cooperate with each other to gear down the pulling force required by cable 72, in order for push-ring 46 to ascend slowly yet forcibly along post 40 to allow the heavy marquee 100 to be deployed as described hereinafter under the single rotation torque induced by a conventional hand drill.

It is understood that by spinning drill socket 64 in the other direction, cable 72 can be unwound from drum 70. However, the unwinding of cable 72 from drum 70 is not sufficient to allow push-ring 46 to descend back towards bottom pulley assembly 74; indeed, a downward force must also be manually applied on push-ring 46, to counteract the action of braking pulleys 73 installed on the top and bottom pulley assemblies. Indeed, if push-ring 46 has been hoisted along post 40 upwardly towards post top end portion 40*a*, and is left in a uplifted position on post 40, braking pulleys 73 will cooperate together to prevent push-ring 46 from descending back towards post bottom end portion 40*b* under the action of gravity-borne forces applied thereon. Accordingly, for push-ring 46 to descend downwardly along post 40, cable 72 must inevitably be unwound from drum 70, by selectively rotating shaft 60, otherwise braking pulleys would prevent a spontaneous descent.

It is understood that the second sprocket mechanism 63', including its own drum, cable and pulley assemblies, will act simultaneously and symmetrically on push-ring 46 for hoisting it along post 40, and allowing its cable to unwind for descending push-ring 46 along post 40.

As illustrated in FIGS. 5–7, push-ring 46 comprises a finger mechanism 75, whose purpose will be set forth hereinafter. Finger mechanism 75 comprises two axles 77, 77', each one of axles 77, 77' pivotally and successively extending through a pivot member 78 (only the pivot member 78 attached to axle 77 being shown in the drawings), and then through a pivot member 79, 79', which is integrally attached to and protrudes from push-ring 46; each one of axles 77, 77' can be pivoted about a respective pivot axis 80, 80' relative to pivot members 78 and 79, 79'. Two hook-shaped fingers 76, 76', each defining an elongated portion 76*a*, 76*a'* and a nib 76*b*, 76*b'*, are fixedly attached at one end of elongated portions 76*a*, 76*a'* to the end of axles 77, 77' adjacent pivot members 78, perpendicularly thereto. One end of connecting levers 82, 82' is fixedly attached at the opposite ends of axles 77, 77' perpendicularly thereto, and forms an obtuse angle with elongated portions 76*a*, 76*a'* of fingers 76, 76' (for example, forming an angle of 95° with fingers 76, 76'). Each one of connecting levers 82, 82' is pivotally connected at the other end to a corresponding pivot pin 83 (only the pin 83 attached to lever 82 being shown in the drawings), which is attached to a nut 84. Nut 84 threadingly engages a vertically arranged bolt 86; bolt 86 extends through, and pivotally and non-threadingly engages top and bottom pivot members 87, 88 attached to the outer wall of groove 47. The top end of bolt 86 which protrudes upwardly beyond top pivot member 87 is fixedly secured with a nut, to prevent egress of bolt 86 out of pivot member 87; an eyelet 90 is fixedly attached to the bottom end of bolt 86 protruding downwardly beyond bottom pivot member 88.

Figure 11:
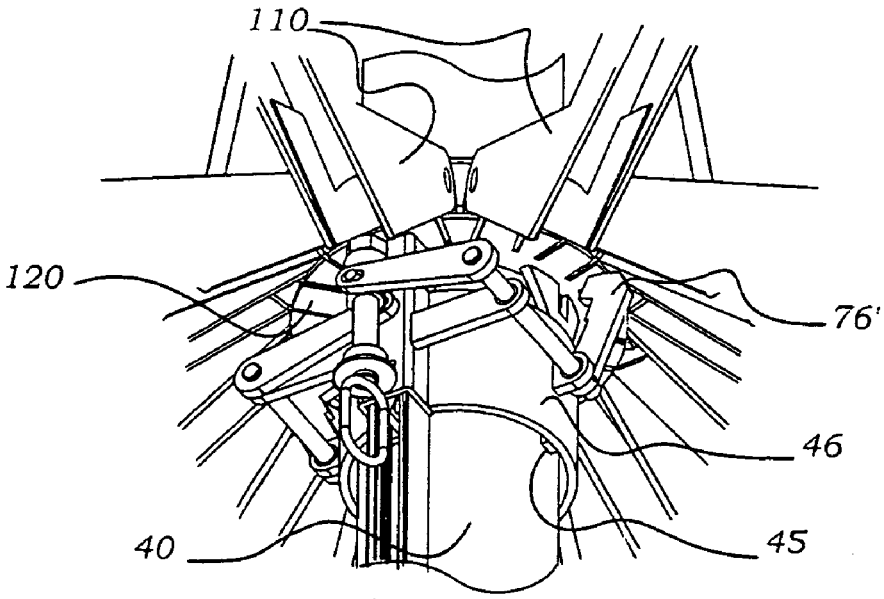
FIGS. 11–13 show enlarged perspective views of the push-ring and spreader ring engaging the post, FIGS. 11–13 sequentially showing, with the inner end of the spreader braces being shown, the pivotal movement of two fingers attached to the side of the push-ring and the downward displacement of the push-ring and of the spreader ring along the post.
Figure 12:
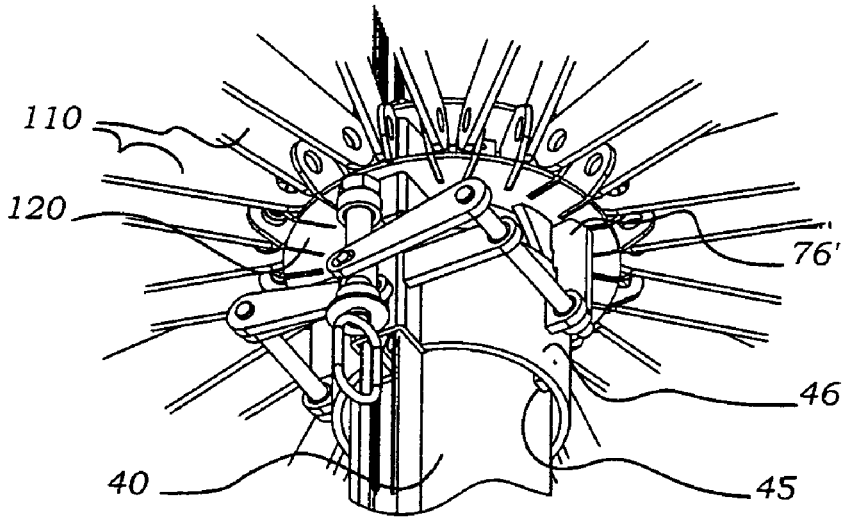
Figure 13:
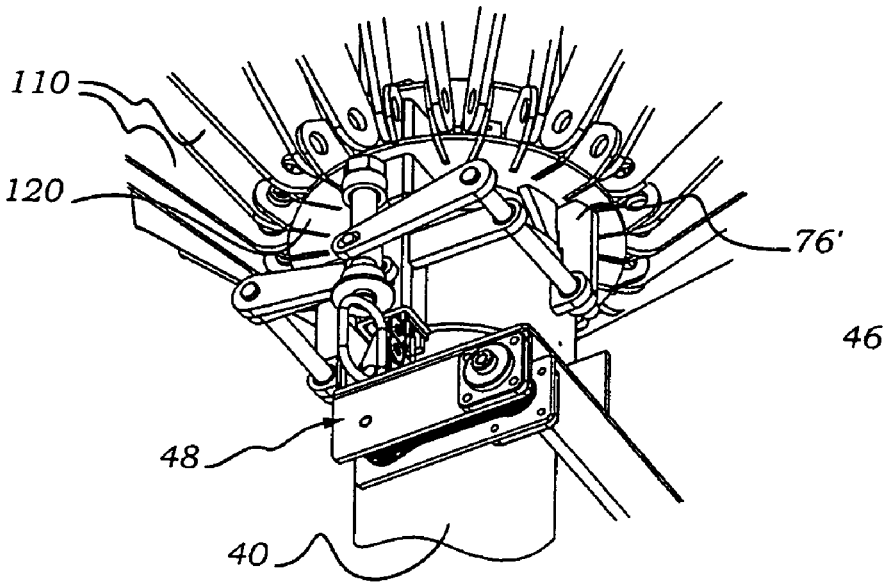

Eyelet 90 is destined to be manually rotated, for example with an independent, manually controlled elongated hook-provided stick or the like tool (not shown), to rotate bolt 86. Upon bolt 86 being rotated about its attachment to pivot members 87, 88, the threads of bolt 86 cooperate with that of nut 84 in order for the latter to be set in axial motion about bolt 86. As nut 84 axially moves about bolt 86, the end of levers 82, 82' connected to pins 83 of nut 84 will follow the latter's movement about bolt 86, hence pivoting axles 77, 77', and thus fingers 76, 76', about axes 80, 80'. Upon nut 84 being driven upwardly along bolt 86, fingers 76, 76' will be pivoted away from post 40, as illustrated in FIGS. 5 and 11. Upon nut 84 being driven downwardly along bolt 86, fingers 76, 76' will be pivoted towards post 40, as illustrated in FIGS. 6, 12 and 13.

Figure 8:
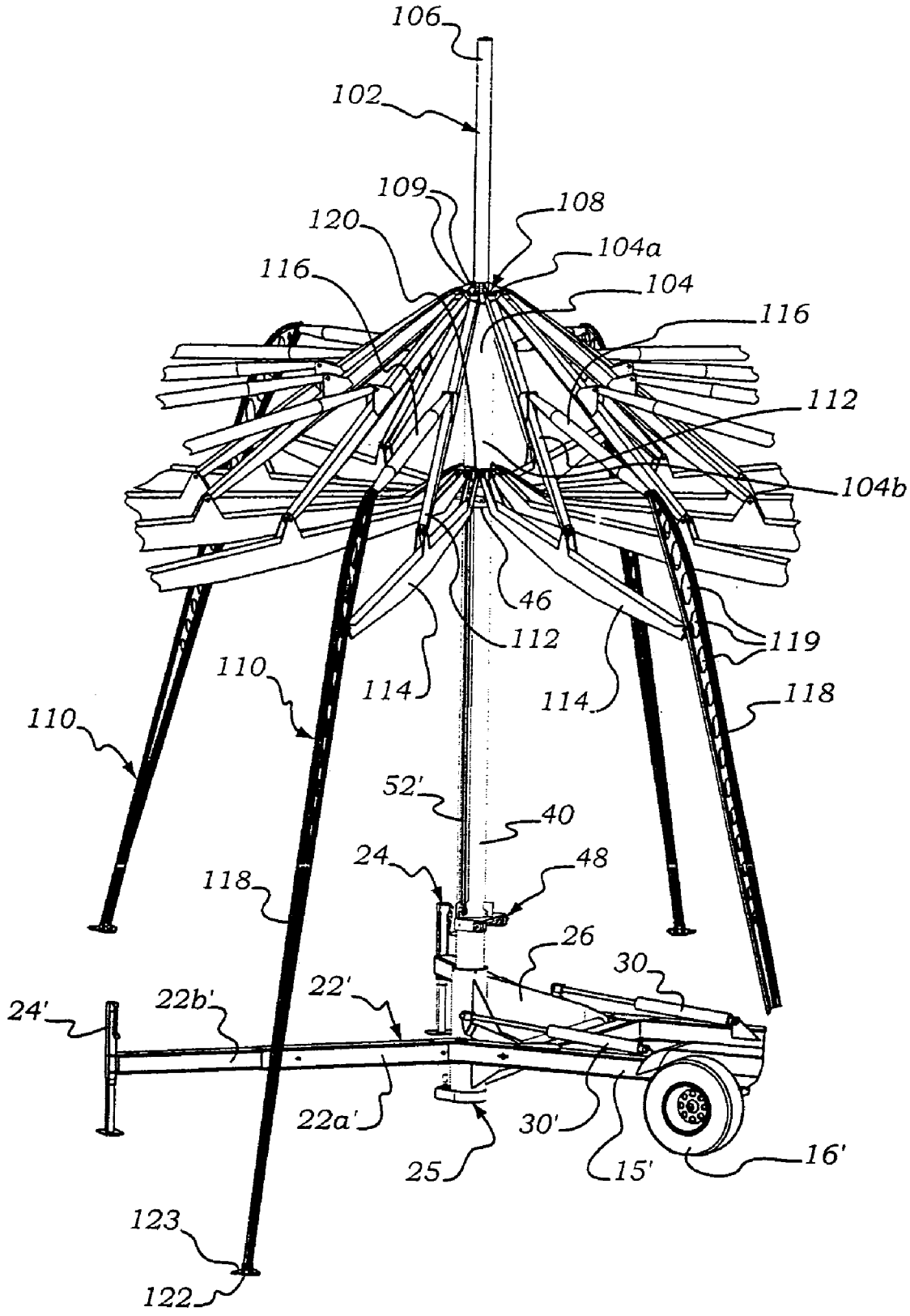
FIG. 8 shows a rear perspective view of the shelter, with the marquee being deployed and with the canvas removed.

As shown in FIG. 8, marquee 100 comprises a frame 102, which in turn comprises an elongated tubular and cylindrical trunk member 104 defining a top end 104*a* and a bottom end 104*b*. Frame 102 further comprises an elongated cylindrical transportation rod portion 106 extending upwardly from the top end 104*a* of trunk member 104*b* coaxially therewith. Lower portion 104 has a diameter equal or substantially equal to that of post 40, for reasons detailed hereinafter.

An attachment ring 108 is fixedly mounted to frame 102, at the junction between trunk member 104 and rod portion 106; ring 108 comprises a circular array of brace attachment members 109. A circular array of articulated brace assemblies 110 is attached to frame 102, through the instrumentality of attachment ring 108.

Each brace assembly 110 comprises the following pivotally interconnected braces:

a frame connecting brace 112, pivotally connected at one end to a corresponding brace attachment member 109 of attachment ring 108, thereby fixedly and pivotally linking brace assemblies 110 to frame 102; frame connecting brace 112 being pivotally attached at the other end to an intermediate portion of a spreader brace 114, pivotally attached at one end to spreader ring 120 (also called spreader member 120 herein) which will be described hereinafter; brace 114 is pivotally attached at the other end to an intermediate upper portion of a ground-resting brace 118, comprising a number of holes 119 made therein; brace 118 defining a first ground-resting end, to which a foot 122 is integrally attached, foot 122 being provided with stake holes 132 thereon; brace 118 further defining a second opposite end, pivotally attached to one end of an intermediate brace 116, pivotally connected at the end opposite its connection to brace 118 to an intermediate portion of frame connecting brace 112.

Braces 112, 114, 116, 118 are made of a sturdy material, such as machined aluminium or other composite materials such as Kevlar® fibres or fibreglass, and are suitably profiled to withstand high quantities of mechanical stresses without deforming.

Figure 17:
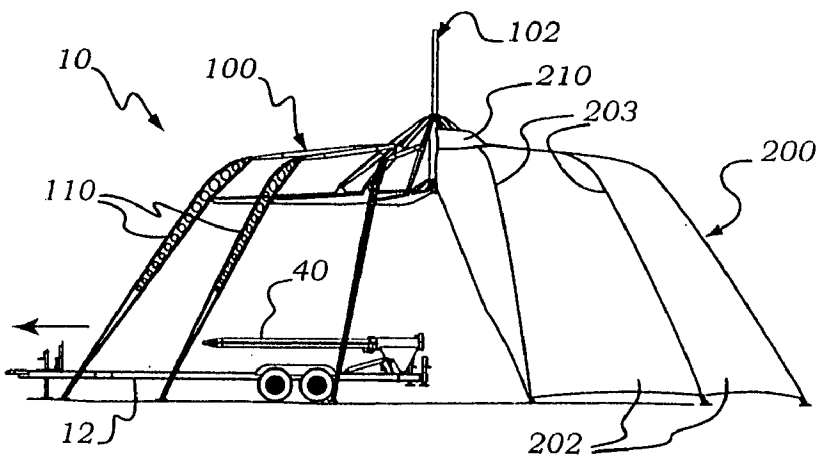
Figure 14:
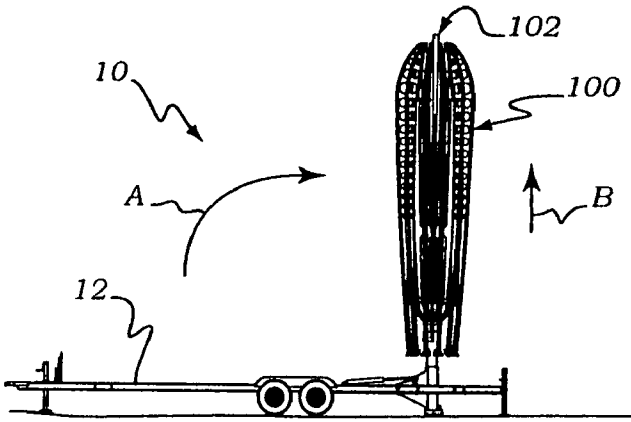
Figure 16:
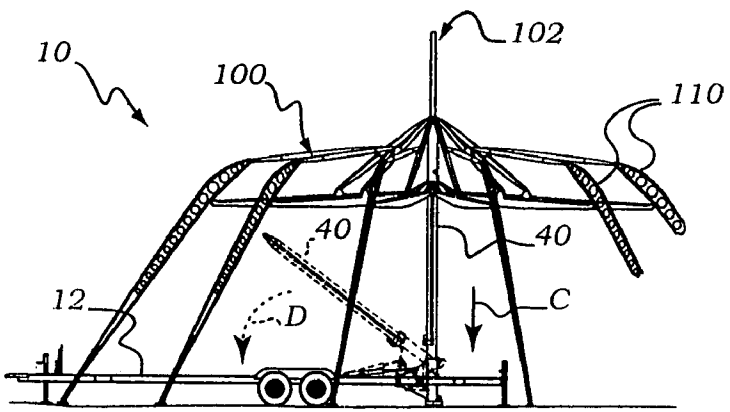
Figure 18:
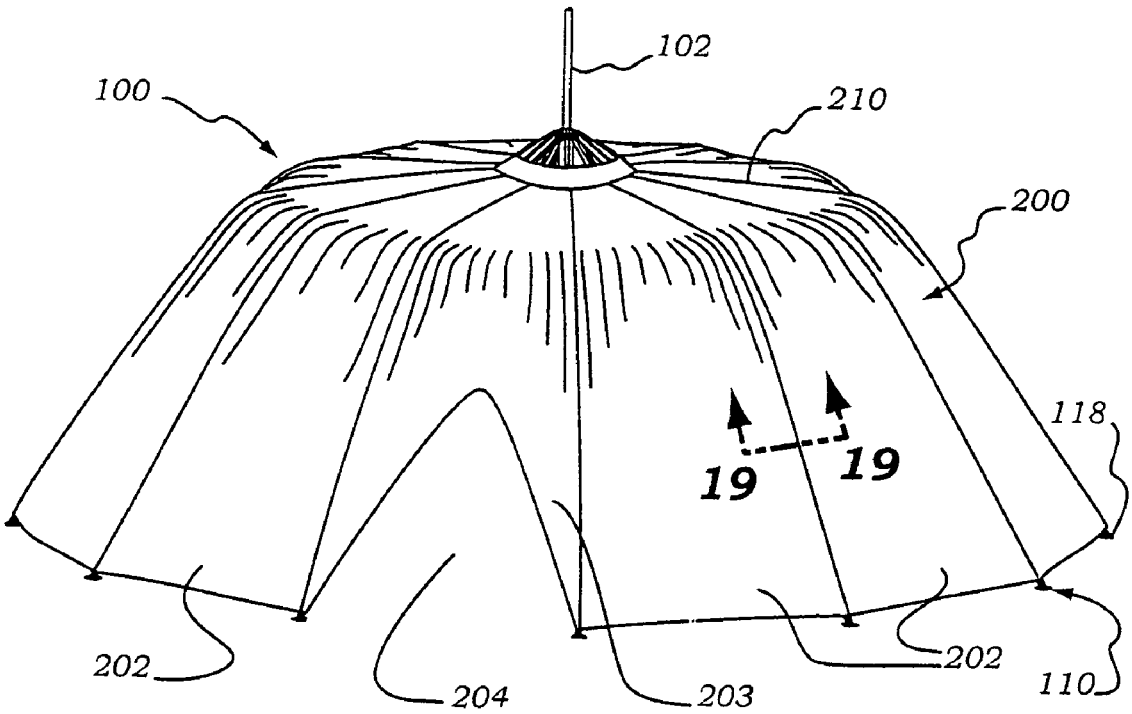
FIG. 18 shows a perspective view of the marquee in a fully deployed condition.
Figure 19:
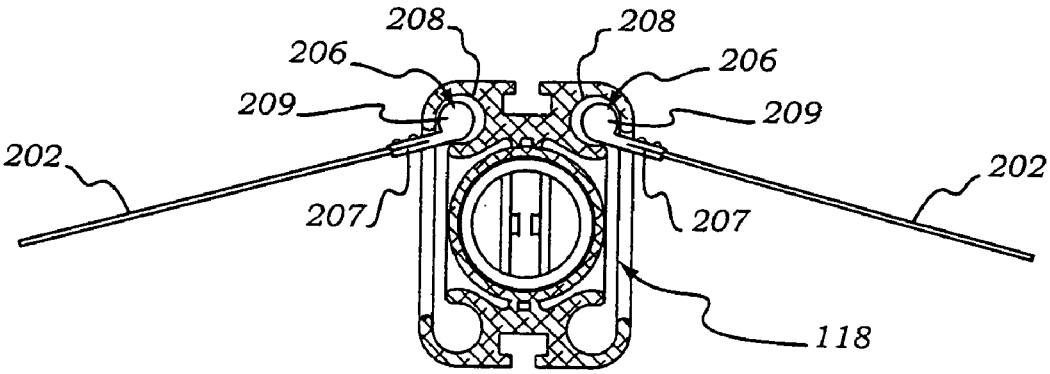
FIG. 19 shows an enlarged cross-sectional view taken along lines 19—19 of figure 18.

Moreover, each ground-resting brace 118 comprises two longitudinal canvas attachment slots 208, as shown in FIG. 19. A canvas 200 is attached to marquee 100, as shown in FIGS. 17–19, which comprises a number of consecutive lateral canvas portions 202 and at least one canvas portion 203 comprising an opening 204 therein; canvas opening 204 will serve as an entrance for marquee 100, when it is in an operative condition. Lateral canvas portions 202, 203 each define two longitudinal edges, along which are attached elongated attachment ribs 206 (FIG. 19). More particularly, the longitudinal edges of each lateral canvas portion are pressure fitted into flat longitudinal slots 207 provided in ribs 206. Each one of ribs 206 also has an elongated cylindrical portion 209 which engages a corresponding slot 208 in one of ground-resting braces 118, to form a dovetail-type engagement therewith. Thereby, through this rib-and-slot type connection, each canvas portion 202, 203 is secured to and stretched between two consecutive ground-resting braces 118. Ground-resting braces 118 and canvas portions 203, 204 do not extend all the way to the top of marquee 200, and consequently a rib-free portion top canvas portion 210 is provided to cover the upper portion of the marquee framework. Top canvas portion 210 rests on and is attached to intermediate braces 116 and on the upper portion of frame connecting braces 112. Top canvas portion 210 is bored to allow transportation rod 106 to extend therethrough.

As presented hereinabove, spreader brace 114 is connected at one end to spreader ring 120. Spreader ring 120 comprises a circular array of brace attachment members 121 integrally, outwardly and radially protruding therefrom, to which spreader braces 114 are pivotally attached. Spreader ring 120 comprises two lateral grooves 122, 122', as illustrated in FIG. 7, similar to grooves 47, 47' of push-ring 46, located at diametrically opposite locations around ring 120. Spreader ring 120 can slidably engage post 40 between push-ring 46 and post 40. Grooves 122, 122' are sized to accommodate tracks 52, 52' therein when spreader ring 120 engages post 40. Spreader ring 120 can also engage and be releasably attached to the marquee frame trunk member 104 (as described hereinafter), and comprises two frame attachment apertures 124, 124' therefore (as shown in FIGS. 5–7) located at diametrically opposite positions on ring 120.

Figure 9:
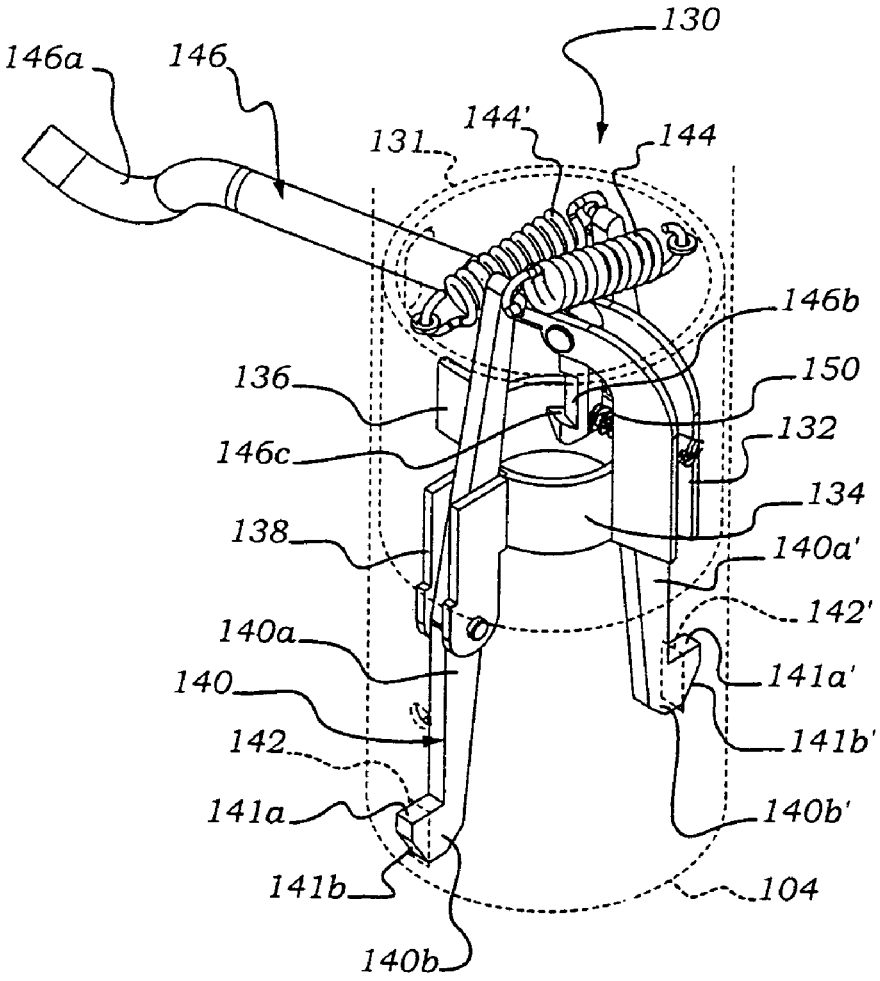
FIG. 9 shows an enlarged perspective view of the attachment mechanism mounted in the frame of the marquee, with the marquee trunk member being shown in dotted lines.
Figure 10:
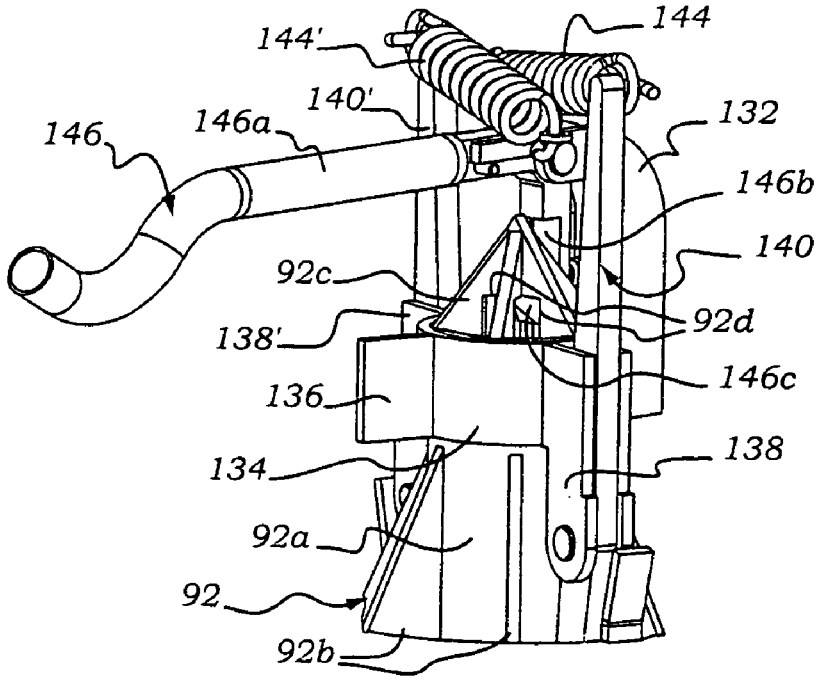
FIG. 10 shows an enlarged perspective view similar to that of FIG. 9, but with the top portion of the post engaging the attachment mechanism.

As illustrated in FIGS. 9–10, a tubular collar 131 snugly engages the inner wall of tubular trunk member 104 at the vicinity of frame trunk member bottom end 104*b*, and is fixedly secured thereto. A spring-loaded attachment mechanism 130 is provided within the inner cavity of frame trunk member 104, and is partially nested within the confines of collar 131.

Attachment mechanism 130 comprises an elbowed attachment bracket 132 firmly secured to the inner wall of collar 131. A cylindrical post engagement neck 134 is integrally attached to bracket 132, and neck 134 is suitably disposed within frame trunk member 104 to be coaxially aligned therewith. Opposite its attachment to bracket 132, post engagement neck 134 integrally comprises an alignment tab 136, whose free end pressurizingly engages the inner wall of collar 131, to prevent an accidental displacement of neck 134 relative to marquee frame trunk member 104, and to thus keep neck 134 coaxially aligned within trunk member 104.

Neck 134 further comprises two integral side attachment pivot members 138, 138' depending from neck 134 in an elbowed fashion, and located at diametrically opposite locations thereon. Two releasable attachment hook members 140, 140', defining a main shank portion 140*a*, 140*a*' and a retaining portion 140*b*, 140*b*' protruding from the lower end of shank portion 140*a*, 140*a*', are pivotally attached at the middle area of shank portion 140*a*, 140*a*' to pivot members 138, 138'. Each one of retaining portions 140*b*, 140*b*' defines a top horizontal flat edge 141*a*, 141*a*', and a push-edge 141*b*, 141*b*' sloped inwardly downwardly. Retaining portions 140*b*, 140*b*' emerge radially outwardly from the inside of frame trunk member 104 through two apertures 142, 142' made thereon. Retaining portions 140*b*, 140*b*' are continuously radially outwardly biased through the instrumentality of springs 144, 144' tensioned between the upper end of shank portion 140*a*, 140*a*' and the top rim of collar 131.

Attachment mechanism 130 is also provided with a post disengagement lever 146. Lever 146 defines a handle portion 146*a*, and a wedge portion 146*b* integrally attached to an inner end of handle portion 146*a* and forming an elbow therewith. Wedge portion 146*b* comprises a hook portion 146*c* protruding from its lower free extremity. Hook portion 146*c* possesses a horizontal top edge and an inwardly sloping bottom edge similar to edges 141*a*, 141*a*' and 141*b*, 141*b*' of nibs 140*a*, 140*a*'. Lever 146 is pivotally attached, at the elbowed junction of handle portion 146*a* and wedge portion 146*b*, to the free end of bracket 132. Two registering holes are made in both collar 131 and in frame trunk member 104, through which handle portion 146*a* can extend outwardly of frame trunk member 104. A spring 150 is compressed between wedge-portion 146*b* and bracket 132, which continually biases handle portion 146*a* of lever 146 upwardly in FIGS. 9–10, and which consequently continuously biases wedge portion 146*b* away from bracket 132.

Attachment mechanism 130 will serve the dual purpose of releasably securing spreader ring 120 to frame trunk member 104, and of releasably securing post 40 to frame 102, as described hereinafter.

During its transportation, marquee 100 is set in a storage/transport configuration in which it is positioned horizontally to lie atop trailer 12, as illustrated in FIG. 1. In such a storage configuration, on one hand, post 40 is fully retracted inside socket 35, in that its bottom plate 42 is juxtaposed to bottom plate 35*a* of socket 35. On the other hand, fixture 92 of post 40 is inserted into frame trunk member 104. Fixture radial ribs 92*b* snugly engage the inner wall of tubular trunk member 104, and the top end portion of fixture main body 92*a* engages the inner wall of neck 134 (as shown in FIG. 10). The relative arrangement of fixture 92 allow for ribs 92*b* to stay clear and not interfere with moving parts of mechanism 130. Blades 92*c* protrude upwardly beyond the top rim of neck 134, and lever wedge portion 146*b* of attachment mechanism 130 is snugly wedged between two registering consecutive blades 92*c*; lever hook portion 146*c* extends through indentations 92*d* of the same two consecutive blades 92*c*, with the top horizontal edge of hook portion 146*c* engaging the top edge of indentations 92*d*. Hook portion 146*c* is firmly, yet releasably kept engaged in indentations 92*d* under the biasing influence of spring 150, and post 40 is thereby releasably attached to frame trunk member 104.

Spreader ring 120 engages post 40 in the storage configuration of marquee 100, and is coaxially juxtaposed to and located above push-ring 46. Moreover, fingers 76, 76' of push-ring 46 are pivoted towards post 40, and nibs 76*b*, 76*b*' of fingers 76, 76' engage apertures 122, 122' in spreader ring 120; accordingly, push-ring 46 and spreader ring 120 are releasably bound together. Moreover, the assembly of rings 46 and 120 is located at a bottom limit position downwardly on post 40, in order for the lower rim of push-ring 46 to abut against the flat horizontal top edge of brackets 56 (as shown in FIG. 13).

Finally, in this storage configuration, braces 112, 114, 116, 118 are mutually pivoted in order for brace assemblies 110 to be collapsed and folded towards post 40 and frame 102.

The erection procedure of marquee 100 will now be detailed. This procedure consists in shifting the configuration of marquee 100 from the above-described storage configuration, to an erected and deployed configuration. The erection of marquee 100 is sequentially shown in FIGS. 14 through 17.

Firstly, shelter 10 is secured to a car or truck through tow hitch 18 of trailer 12, and shelter 10 is driven to the desired anchoring area, where marquee 100 will be installed. Thereafter, trailer support arms 22, 22', which are folded towards chassis 14 when shelter 10 is being transported (as shown in FIGS. 1–2), are unfolded away from chassis 14, and rod portions 22*b*, 22*b*' are slidably extracted out of sleeve portion 22*a*, 22*a*', as shown in FIG. 3. The cranks of support legs 20, 24, 24' are then suitably handled, in order for their respective sand shoes to rest on the ground; when this is completed, trailer 12 stably rests on the ground, and the deployment procedure of marquee 100 can be initiated.

Hydraulic cylinders 30, 30' are then selectively activated and extracted. As cylinders 30, 30' are being extracted, pivot levers 29, and thus also post base 25, is pivoted about axis 28, as suggested by arrow A in FIGS. 3 and 14. Accordingly, post base 25 is shifted between its horizontal limit position, as shown in FIG. 1, towards its vertical limit position, as shown in FIG. 3. Once this is accomplished, a workman having a drill equipped with a drill bit compatible with drill socket 32*a* protruding from lip 31, can fit the bit of his drill into socket 32*a* of drill adaptor 32, and activate his drill to rotate socket 32*a*. Endless screw 34 being operatively connected to socket 32*a*, it will be driven in a rotary motion along with socket 32*a*. The rotation of endless screw 34 induces an upward axial displacement of post 40 relative to socket 35 of lifting mechanism 27. As post 40 is uplifted, marquee 100 will be similarly uplifted as suggested by arrow B in FIG. 14, in order for feet 122 of brace assemblies 110 to be positioned spacedly over ground and vertically over trailer 12.

Afterwards, the workman can disengage his drill bit from drill socket 32*a*, and can fit his drill bit into drill socket 64 of hoisting system 48. Upon selective activation of the drill, socket 64 is rotated, which commands hoisting system 48 to hoist push-ring 46 upwardly towards post top end portion 40*a*, through the instrumentality of cables 72, 72' and of the pulley assemblies through which they run. At this point, push-ring 46 is bound to spreader ring 120 through the instrumentality of fingers 76, 76'; consequently, spreader ring 120 is pushed upwardly by push-ring 46, and both rings ascend along post 40 in unison.

Figure 15:
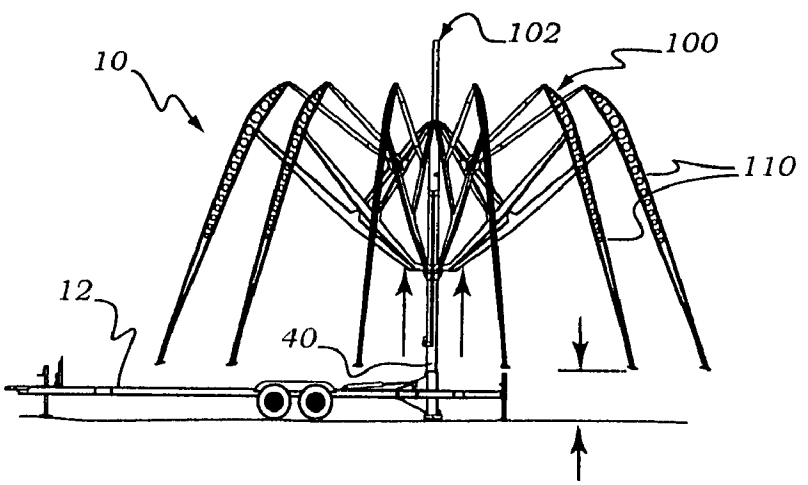
FIG. 14–17 show a deployment sequence of the shelter, with the canvas being partly shown in FIG. 17 and being removed in FIGS. 14–16 for clarity of the drawings.

Spreader brace 114 is pivotally attached to spreader ring 120, as described hereinabove. Accordingly, as spreader ring 120 ascends along post 40 towards post top end 40*a* and thus towards frame trunk member 104, brace 114 will alter the mutual pivotal arrangement of braces 112, 116, and 118: brace assemblies 110 will be progressively shifted from their folded position, where they are collapsed against post 40, and where their ground-resting feet 122 are located at the vicinity of post 40, to a deployed position, where they are expanded away from post 40, and where feet 122 and positioned away from post 40. The deployment of brace assemblies 110 is similar to that of the branches of an umbrella, as illustrated in FIG. 15.

The mutual interconnection of braces 112, 114, 116, 118 is such that feet 122 describe a pseudo-parabolic trajectory during the expansion of brace assemblies 110. When post 40 is extracted out of socket 35, and when brace assemblies 110 are collapsed against post 40, feet 122 are located spacedly over ground and above trailer 12. In a first uphill stage of the deployment course of brace assemblies 110, feet 122 are moved radially away from post 40, and are slightly uplifted relative to their initial collapsed position, hence avoiding trailer 12. Then, after feet 122 have reached the apex of their pseudo-parabolic trajectory, brace assemblies 110 will enter into the second downhill stage of their deployment course, where feet 122 will descend back towards the ground to reach the position illustrated in FIG. 16.

Spreader ring 120, at the end of its upward course, will have to slide on post 40 beyond the top end thereof, and onto frame trunk member 104. Since post 40 is inserted in and coupled to frame trunk member 104, their outer walls are coextensively joined and form a continuous sliding surface, because they both have the same outer diameter. Consequently, spreader ring 120 can slidably ascend along post 40, and slidably pass from post 40 to frame trunk member 104 smoothly and uninterruptedly.

As spreader ring 120 is slidably pushed from post 40 to frame trunk member 104, the top rim of spreader ring 120 will eventually come in contact with spring-biased retaining portions 140*b*, 140*b*' of attachment mechanism 130. As spreader ring 120 is further upwardly pushed, the top rim of spreader ring 120 will push against the sloped pushing edge 141*b*, 141*b*' of retaining portion 140*b*, 140*b*'. Retaining portions 140*b*, 140*b*' are then yieldingly pushed radially inwardly relative to frame trunk member 104, and spreader ring 120 is slid onto and overlaps apertures 142, 142'. The end of the sliding ascension course of spreader ring 120 is reached when push-ring 46 is slid to its highest position on post 40 (it cannot slide past the top pulley assemblies). At this point, apertures 124, 124' of spreader ring 120, which are still engaged by nibs 76*b*, 76*b*' of fingers 76, 76', are in facing and touching register with apertures 142, 142' of frame trunk member 104, and brace assemblies 110 are completely deployed.

Then, the workman, having in his possession an hook-provided elongated stick (not shown) or the like, inserts the hook of the elongated hook-provided stick in eyelet 90 of mechanism 75, and manually rotates the stick about its longitudinal axis to engender a rotary movement of eyelet 90. Accordingly, revolving eyelet 90 sets bolt 86 in a similar rotary motion, in order for nut 84 to ascend along bolt 86. Consequently, both assemblies of levers 82, 82', axle 77, 77' and fingers 76, 76' are pivoted about pivot axes 80, 80' respectively, in order for fingers 76, 76' to be pivoted away from spreader ring 120, and for their nibs 76*b*, 76' to progressively move out of apertures 124, 124' of spreader ring 120. As they are progressively cleared out of apertures 124, 124', nibs 76*b*, 76*b*' will give way to retaining members 140*b*, 140*b*', which will progressively engage apertures 124, 124', as spring-biased hook members 140, 140' are pivoted about pivot members 138, 138'. When nibs 76*b*, 76*b*' are fully cleared from apertures 124, 124', spreader ring 120 is detached from push-ring 46, and retaining members 140*b*, 140*b*' extend through apertures 124, 124', thus releasably securing spreader ring 120 to frame trunk member 104.

The workman can then approach lifting mechanism 27 of post base 25, having the drill in his possession, to drive drill socket 32*a* in the opposite direction than that used to uplift post 40; meanwhile another workman can use the hook-provided elongated stick to pull handle portion 146*a* of lever 146 downwardly, in order to undo the releasable attachment of post 40 to frame trunk member 104. Accordingly post 40 will retract back into socket 35, as suggested by arrow C in FIG. 16, and fixture 92 will slide out of frame trunk member 104, at which point the entire load of marquee 100 will become solely supported by brace assemblies 110. Cylinders 30, 30' are then selectively retracted, and post 40 is pivoted back towards trailer 12 (as suggested by arrow D in FIG. 16). Support legs 20, 24, 24' are then retracted, and arms 22, 22' are folded back towards chassis 14, and trailer 12 can then be driven away between two consecutive ground-resting braces 118, 118, through canvas opening 204. To complete the installation of marquee 100, stakes (not shown) can be driven through stake holes 123 of feet 122 and into the ground, to firmly secure marquee 100 to the ground. The marquee is then installed, and ready to use.

It is understood that during thus installation procedure, canvas 200 will remain attached to its corresponding braces and deploy from a folded configuration to a relatively stretched configuration to cover the whole area located underneath the marquee braces.

The uninstallation procedure will now be detailed. Firstly, trailer 12 is driven underneath marquee 100 between two consecutive ground-resting braces 118, 118, through canvas opening 204, and is stably installed on the ground using arms 22, 22' and support legs 20, 24, 24', and post 40 is pivoted in a vertical stance, in vertical alignment with marquee trunk member 104. Trailer 12 has to be positioned underneath marquee 100 in order for tracks 52, 52' of post 40 to register vertically below guiding grooves 122, 122' of spreader ring 120. If tracks 52, 52' do not register vertically below guiding grooves 122, 122', the workman can align them by manually pivoting post 40 about socket 35. Then, the workman approaches post lifting mechanism 27, and rotates socket 32 with his drill, in order to axially uplift post 40, until fixture 92 progressively engages bottom end 104*b* of frame trunk member 104 and hook portion 146*c* of lever 146 releasably engages indentations 92*d*, i.e. until post 40 is releasably attached to marquee frame trunk member 104.

When post 40 is properly engaged in frame trunk member 104, the workman will use his elongated hook-provided stick to rotate eyelet 90, in order to pivot fingers 76, 76' towards apertures 124, 124', provided that push-ring 46 has reached its highest limit position on post 40. As fingers 76, 76' are pivoted towards and progressively engage apertures 124, 124', retaining members 140*b*, 140*b*' will be yieldingly pushed by nibs 76*b*, 76*b*' radially and inwardly into trunk member 104, against the bias of springs 144, 144', retaining members 140*b*, 140*b*' thus releasing their grip on spreader ring 120. Then, the workman drives drill socket 64 in rotation with his drill, in order to unwind cables 72, 72' from drums 70 of hoisting system 48; meanwhile another worker will pull push-ring 46 down, by gripping it though eyelet 90 and using the hook-provided elongated stick; push ring 46 will in turn pull spreader ring 120 down, and both rings 46, 120 will descend along post 40 in unison. While this is achieved, brace assemblies 110 will progressively fold back and collapse against post 40. When push-ring 46 and spreader ring 120 are in their lowermost position, where the bottom rim of push-ring 46 abuts against the top edge of brackets 56 of hoisting system 48, brace assemblies 110 are fully collapsed. Post 40 can then be retracted downwardly inside socket 35, and post 40, along with collapsed marquee 100, can be pivoted back in a horizontal stance onto trailer 12, where top frame portion 106 will abut on and be supported by bracket 21. The trailer anchoring ensured by support legs 20, 24, 24' is then undone, arms 22, 22' are folded back towards chassis 14, and the uninstallation is complete. It is understood that canvas 200 remains installed on the marquee braces in this collapsed configuration of the braces, even though it is not shown in FIG. 1.

Deployed marquee 100, which can be very vast, e.g. can have a 40 meter (130 ft.) diameter, a height of 12 meters (40 ft.), and a total underlying area of 1256 square meters (13200 $ft^2$), can be collapsed into a very compact form. Indeed, the assembly of trailer 12 carrying a marquee 100 in a stored position will relatively compact, i.e. this assembly will have a height of 2.5 meters (8 ft.) and a length of 13.75 meters (45 ft.), for a marquee having the above-mentioned dimensions in a deployed position.

Moreover, as can be inferred from the above-described installation and uninstallation procedures, marquee 100 can be assembled quickly and easily. In a general manner, only a drill, an elongated post, a motorized vehicle to which is attached trailer 12, and two workers are required to assemble marquee 100. According to some alternate embodiments, a single worker without any power tools could even be sufficient to install marquee 100. Its assembly approximately takes one hour to complete, and requires no intense physical effort. Moreover, these two workers need very little knowledge in order to set up the marquee. For a traditional marquee of these dimensions, the team of numerous workers required to assemble the marquee needs in-depth knowledge of its installation and uninstallation procedures. Finally, accidents are not likely to happen during the installation/uninstallation of marquee 100, as opposed to the high risk which workers are exposed to when setting up a traditional marquee (accidental collapse of the marquee because of incorrectly assembled parts, etc.)

Alternate ways could be envisioned to carry out some aspects of the present invention. For example, post lifting mechanism 27 could be designed in any suitable way that could allow an axial displacement of post 40 about socket 35. Also, instead of providing post 40 with a push-ring 46 and a hoisting system 48, any means known in the art could be provided on post 40 for actuating spreader ring 120 up and down about post 40. Also, instead of attachment mechanism 130, alternate releasable attachment means could be provided to attach spreader ring 120, and post 40, to frame 102.

Also, reinforcement cables could be attached between each two consecutive brace assemblies 110, to further strengthen the marquee's structure, thereby providing it with increased stability and enhanced resistance to high winds impinging on the marquee's canvas.

It is further envisioned, in yet another alternate embodiment, to provide a post that is pivotally mounted to the marquee frame trunk at its top end, and that is releasably attached to the trailer at its bottom end. With a shelter according to this alternate embodiment, upon the spreader ring reaching its topmost position when the braces are completely deployed, the post would be detached from the trailer and upwardly pivoted about its top end to a stored position adjacent the spreader braces, instead of being carried away by the trailer.

In another alternate embodiment of the invention, it is envisioned to provide a post divided into two portions linked with a pivotable articulation. This articulation would allow to install and/or retrieve the marquee without having to align the vehicle vertically under the marquee frame trunk, since the first post portion extending from the vehicle could be inclined while the second post portion extending from the marquee frame trunk would remain vertical to engage the marquee frame trunk.

Other modifications and improvements will occur to those skilled in the art upon a reading of the foregoing description. It should be understood that all such modifications and improvements have not been included herein for the sake of conciseness, but are properly within the scope of the appended claims.

The invention claimed is:

1. A mobile shelter comprising:

a vehicle movable over ground;

a post defining opposite first and second end portions;

a post attachment base pivotally attached to said vehicle and pivotable relative thereto about a substantially horizontal base pivot axis, said post attachment base carrying said post second end portion and spacing said post away from said base pivot axis, with said post perpendicular to said base pivot axis, wherein said post can pivot between a stored position in which said post lies above said vehicle in a transport condition and in which said post second end portion is destined to be located spacedly above ground, and a deployment position in which said post is erected and in which said post second end portion is destined to be located close to the ground; and a collapsible marquee comprising:

a frame, releasably attachable to said post first end portion, a number of articulated brace assemblies attached to said frame, and defining a ground-resting end, said articulated brace assemblies being movable relative to said frame between a storage position in which said brace assemblies are collapsed against said post, and a deployed position in which said brace assemblies are deployed away from said post to define a canvas-sheltered usable area and in which said ground-resting ends of said brace assemblies are destined to rest on the ground to support said marquee; and a canvas carried by said brace assemblies;

wherein when said brace assemblies are in said deployed position, said post first end portion can he released from said frame, and said vehicle can be moved away from said marquee with said post to clear said canvas-sheltered usable area.

2. The shelter as defined in claim 1, wherein said post attachment base comprises at least one elongated flange, pivotally attached at a first end to said vehicle and carrying said post second end portion at a second end, said flange spacing said post away from said base pivot axis.

3. The shelter as defined in claim 2, wherein said post attachment base comprises a post lifting mechanism including a socket attached to said flange second end, said post second end portion slidably engaging said socket, whereby said post lifting mechanism can be selectively activated to allow said post second end portion to be moved along and within said socket between inner and outer limit positions.

4. The shelter as defined in claim 2, wherein when said brace assemblies are in said storage position and said post is in said deployment position, said ground resting ends of said brace assemblies are positioned spacedly over ground, and during movement of said brace assemblies from said storage position to said deployed position, said ground-resting ends of said brace assemblies will describe a pseudo-parabolic trajectory in order for said ground-resting ends to move over and avoid said vehicle in a first trajectory portion of said pseudo-parabolic trajectory and for said ground-resting ends to move downwardly towards to the ground in a second downward trajectory portion of said pseudo-parabolic trajectory.

5. The shelter as defined in claim 2, wherein said brace assemblies each define a first pivot joint pivotally attached to said marquee frame, and a second pivot joint pivotally attached to a spreader member, said spreader member movably engaging and being guided along said post to move said brace assemblies between said storage position and said deployed position.

6. The shelter as defined in claim 5, wherein each said brace assembly comprises:

a frame connecting brace defining a first end pivotally connected to said marquee frame and a second end opposite said first end;

a spreader brace defining a first end pivotally connected to said spreader member, and a second end opposite said first end, with said second end of said frame connecting brace being pivotally attached to said spreader member intermediate said spreader brace first and second ends;

a ground-resting brace having a first end destined to rest on the ground in said deployed position of said brace assembly and a second end opposite said first end, with said second end of said spreader brace being pivotally attached to said ground-resting brace intermediate said ground-resting brace first and second ends; and an intermediate brace having a first end pivotally connected to said frame connecting brace first and second ends, and a second end opposite said first end and pivotally connected to said ground-resting brace second end.

7. The shelter as defined in claim 5, wherein an actuator is provided on said shelter, which can be activated to forcibly drive said spreader member along said post.

8. The shelter as defined in claim 7, wherein said actuator comprises a hoisting system carried by said post, and a pushing member operatively connected to said hoisting system and slidably engaging said post; and wherein said spreader member is located intermediate said pushing member and said frame when said spreader member engages said post, and wherein upon activation of said hoisting system, said pushing member will be forcibly driven along said post to slidably carry said spreader member.

9. The shelter as defined in claim 8, wherein when said spreader member engages said post, said spreader member is releasably coupled to said pushing member.

10. The shelter as defined in claim 9, wherein said spreader member comprises a spreader ring having at least one attachment aperture made thereon, and said pushing member comprises a push-ring pivotally carrying at least one attachment finger, wherein said attachment finger of said push-ring can be selectively pivoted to engage said attachment aperture of said spreader ring in order for said push-ring and said spreader ring to be releasably coupled.

11. The shelter as defined in claim 5, wherein when said brace assemblies are in said deployed position, said spreader member is releasably attached to said marquee frame and clears said post.

12. A mobile shelter comprising:

a vehicle movable over ground;

a post comprising, at opposite ends, first and second coupling members;

a post attachment base pivotally attached to said vehicle and pivotable relative thereto about a substantially horizontal base pivot axis, said post attachment base carrying said post second coupling member and spacing said post away from said base pivot axis, with said post perpendicular to said base pivot axis, wherein said post can pivot between a stored position in which said post lies above said vehicle in a transport condition and in which said post second end portion is destined to be located spacedly above ground, and a deployment position in which said post is erected and in which said post second end portion is destined to be located close to the ground; and a collapsible marquee comprising:

a frame, attached to said post through the instrumentality of said first coupling member, a number of articulated brace assemblies attached to said frame, and defining a ground-rusting end, said articulated brace assemblies being movable relative to said frame between a storage position in which said brace assemblies are collapsed against said post, and a deployed position in which said brace assemblies are deployed away from said post to define a canvas-sheltered usable area and in which said ground-resting ends of said brace assemblies are destined to rest on the ground to support said marquee; and a canvas carried by said brace assemblies;

wherein when said brace assemblies are in said deployed position, said post first end portion can he released from said frame, and said vehicle can be moved away from said marquee with said post to clear said canvas-sheltered usable area.

13. The shelter as defined in claim 12, wherein said post attachment base comprises at least one elongated flange, pivotally attached at a first end to said vehicle and carrying said post second coupling member at a second end, said flange spacing said post away from said base pivot axis.

14. The shelter as defined in claim 13, wherein said post second coupling member is releasable, said post being thereby releasably attached to said post attachment base, and wherein said first coupling member is pivotable, said post being thereby pivotally attached to said frame; wherein when said brace assemblies are in said deployed position, said post can be released from said post attachment base, said vehicle can be driven away from said marquee, and said post can be pivoted about said first post coupling member into a stored position adjacent at least one of said brace assemblies to clear said canvas-sheltered usable area.

15. The shelter as defined in claim 13, wherein said post first coupling member is releasable, said post being thereby releasably attached to said frame; and wherein when said brace assemblies are in said deployed position, said post can be released from said frame, and said vehicle can be driven away with said post from said marquee to clear said canvas-sheltered usable area.

16. The shelter as defined in claim 15, wherein said post attachment base comprises a post lifting mechanism including a socket attached to said flange second end, said post slidably engaging said socket, whereby said post lifting mechanism can be selectively activated to allow said post to be moved along and within said socket between inner and outer limit positions.

17. The shelter as defined in claim 15, wherein when said brace assemblies are in said storage position and said post is in said deployment position, said ground resting ends of said brace assemblies are positioned spacedly over ground, and during movement of said brace assemblies from said storage position to said deployed position, said ground-resting ends of said brace assemblies will describe a pseudo-parabolic trajectory in order for said ground-resting ends to move over and avoid said vehicle in a first trajectory portion of said pseudo-parabolic trajectory and for said ground-resting ends to move downwardly towards to the ground in a second downward trajectory portion of said pseudo-parabolic trajectory.

18. The shelter as defined in claim 15, wherein said brace assemblies each define a first pivot joint pivotally attached to said marquee frame, and a second pivot joint pivotally attached to a spreader member, said spreader member movably engaging and being guided along said post to move said brace assemblies between said storage position and said deployed position.

19. The shelter as defined in claim 18, wherein each said brace assembly comprises:

a frame connecting brace defining a first end pivotally connected to said marquee frame and a second end opposite said first end;

a spreader brace defining a first end pivotally connected to said spreader member, and a second end opposite said first end, with said second end of said frame connecting brace being pivotally attached to said spreader member intermediate said spreader brace first and second ends;

a ground-resting brace having a first end destined to rest on the ground in said deployed position of said brace assembly and a second end opposite said first end, with said second end of said spreader brace being pivotally attached to said ground-resting brace intermediate said ground-resting brace first and second ends; and an intermediate brace having a first end pivotally connected to said frame connecting brace first and second ends, and a second end opposite said first end and pivotally connected to said ground-resting brace second end.

20. The shelter as defined in claim 18, wherein an actuator is provided on said shelter, which can be activated to forcibly drive said spreader member along said post.

21. The shelter as defined in claim 20, wherein said actuator comprises a hoisting system carried by said post, and a pushing member operatively connected to said hoisting system and slidably engaging said post; and wherein said spreader member is located intermediate said pushing member and said frame when said spreader member engages said post, and wherein upon activation of said hoisting system, said pushing member will be forcibly driven along said post to slidably carry said spreader member.

22. The shelter as defined in claim 21, wherein when said spreader member engages said post, said spreader member is releasably coupled to said pushing member.

23. The shelter as defined in claim 22, wherein said spreader member comprises a spreader ring having at least one attachment aperture made thereon, and said pushing member comprises a push-ring pivotally carrying at least one attachment finger, wherein said attachment finger of said push-ring can be selectively pivoted to engage said attachment aperture of said spreader ring in order for said push-ring and said, spreader ring to be releasably coupled.

24. The shelter as defined in claim 18, wherein when said brace assemblies are in said deployed position, said spreader member is releasably attached to said marquee frame and clears said post.

25. A mobile shelter comprising:

a vehicle movable over ground;

a post defining opposite first and second end portions;

a post attachment base pivotally attaching said post second end portion to said vehicle so as to allow said post to pivot relative to said vehicle about a substantially horizontal base pivot axis perpendicular to said post and spaced from said post by said post attachment base so as to allow said post to pivot between a stored position in which said post lies above said vehicle in a transport condition and in which said post second end portion is destined to be located spacedly above ground, and a deployment position in which said post is erected and in which said post second end portion is destined to be located close to the ground; and a collapsible marquee comprising:

a frame, releasably attachable to said post first end portion, a number of articulated brace assemblies attached to said frame, and defining a ground-resting end, said articulated brace assemblies being movable relative to said frame between a storage position in which said brace assemblies are collapsed against said post, and a deployed position in which said brace assemblies are deployed away from said post to define a canvas-sheltered usable area and in which said ground-resting ends of said brace assemblies are destined to rest on the ground to support said marquee; and a canvas carried by said brace assemblies;

wherein when said brace assemblies are in said deployed position, said post first end portion can be released from said frame, and said vehicle can be moved away from said marquee with said post to clear said canvas-sheltered usable area; wherein said post attachment base comprises at least one elongated flange, pivotally attached at a first end to said vehicle and carrying said post second end portion at a second end, said flange spacing said post away from said base pivot axis.

26. The shelter as defined in claim 25, wherein said post attachment base comprises a post lifting mechanism including a socket attached to said flange second end, said post second end portion slidably engaging said socket, whereby said post lifting mechanism can be selectively activated to allow said post second end portion to be moved along and within said socket between inner and outer limit positions.

27. The shelter as defined in claim 25, wherein when said brace assemblies are in said storage position and said post is in said deployment position, said ground resting ends of said brace assemblies are positioned spacedly over ground, and during movement of said brace assemblies from said storage position to said deployed position, said ground-resting ends of said brace assemblies will describe a pseudo-parabolic trajectory in order for said ground-resting ends to move over and avoid said vehicle in a first trajectory portion of said pseudo-parabolic trajectory and for said ground-resting ends to move downwardly towards to the ground in a second downward trajectory portion of said pseudo-parabolic trajectory.

28. The shelter as defined in claim 25, wherein said brace assemblies each define a first pivot joint pivotally attached to said marquee frame, and a second pivot joint pivotally attached to a spreader member, said spreader member movably engaging and being guided along said post to move said brace assemblies between said storage position and said deployed position.

29. The shelter as defined in claim 28, wherein each said brace assembly comprises:

a frame connecting brace defining a first end pivotally connected to said marquee frame and a second end opposite said first end;

a spreader brace defining a first end pivotally connected to said spreader member, and a second end opposite said first end, with said second end of said frame connecting brace being pivotally attached to said spreader member intermediate said spreader brace first and second ends;

a ground-resting brace having a first end destined to rest on the ground in said deployed position of said brace assembly and a second end opposite said first end, with said second end of said spreader brace being pivotally attached to said ground-resting brace intermediate said ground-resting brace first and second ends; and an intermediate brace having a first end pivotally connected to said frame connecting brace first and second ends, and a second end opposite said first end and pivotally connected to said ground-resting brace second end.

30. The shelter as defined in claim 28, wherein an actuator is provided on said shelter, which can be activated to forcibly drive said spreader member along said post.

31. The shelter as defined in claim 30, wherein said actuator comprises a hoisting system carried by said post, and a pushing member operatively connected to said hoisting system and slidably engaging said post; and wherein said spreader member is located intermediate said pushing member and said frame when said spreader member engages said post, and wherein upon activation of said hoisting system, said pushing member will be forcibly driven along said post to slidably carry said spreader member.

32. The shelter as defined in claim 31, wherein when said spreader member engages said post, said spreader member is releasably coupled to said pushing member.

33. The shelter as defined in claim 32, wherein said spreader member comprises a spreader ring having at least one attachment aperture made thereon, and said pushing member comprises a push-ring pivotally carrying at least one attachment finger, wherein said attaebment finger of said push-ring can be selectively pivoted to engage said attachment aperture of said spreader ring in order for said push-ring and said spreader ring to be releasably coupled.

34. The shelter as defined in claim 28, wherein when said brace assemblies are in said deployed position, said spreader member is releasably attached to said marquee frame and clears said post.

35. A mobile shelter comprising:

a vehicle movable over ground;

a post comprising, at opposite ends, first and second coupling members;

a post attachment base pivotally attaching said post second coupling member to said vehicle so as to allow said post to pivot relative to said vehicle about a substantially horizontal base pivot axis perpendicular to said post and spaced from said post by said post attachment base so as to allow said post to pivot between a stored position in which said post lies above said vehicle in a transport condition and in which said post second end portion is destined to be located spacedly above ground, and a deployment position in which said post is erected and in which said post second end portion is destined to be located close to the ground; and a collapsible marquee comprising:

a frame, attached to said post through the instrumentality of said first coupling member, a number of articulated brace assemblies attached to said frame, and defining a ground-resting end, said articulated brace assemblies being movable relative to said frame between a storage position in which said brace assemblies are collapsed against said post, and a deployed position in which said brace assemblies are deployed away from said post to define a canvas-sheltered usable area and in which said ground-resting ends of said brace assemblies are destined to rest on the ground to support said marquee; and a canvas carried by said brace assemblies;

wherein at least one of said first and second coupling members is a releasable attachment joint and wherein when said brace assemblies are in said deployed position, said post can be moved away from said canvas-sheltered usable area. and wherein said post attachment base comprises at least one elongated flange, pivotally attached at a first end to said vehicle and carrying said post second coupling member at a second end, said flange spacing said post away from said base pivot axis.

36. The shelter as defined in claim 35, wherein said post second coupling member is releasable, said post being thereby releasably attached to said post attachment base, and wherein said first coupling member is pivotable, said post being thereby pivotally attached to said frame; wherein when said brace assemblies are in said deployed position, said post can be released from said post attachment base, said vehicle can be driven away from said marquee, and said post can be pivoted about said first post coupling member into a stored position adjacent at least one of said brace assemblies to clear said canvas-sheltered usable area.

37. The shelter as defined in claim 35, wherein said post first coupling member is releasable, said post being thereby releasably attached to said frame; and wherein when said brace assemblies are in said deployed position, said post can be released from said frame, and said vehicle can be driven away with said post from said marquee to clear said canvas-sheltered usable area.

38. The shelter as defined in claim 37, wherein said post attachment base comprises a post lifting mechanism including a socket attached to said flange second end, said post slidably engaging said socket, whereby said post lifting mechanism can be selectively activated to allow said post to be moved along and within said socket between inner and outer limit positions.

39. The shelter as defined in claim 37, wherein when said brace assemblies are in said storage position and said post is in said deployment position, said ground resting ends of said brace assemblies are positioned spacedly over ground, and during movement of said brace assemblies from said storage position to said deployed position, said ground-resting ends of said brace assemblies will describe a pseudo-parabolic trajectory in order for said ground-resting ends to move over and avoid said vehicle in a first trajectory portion of said pseudo-parabolic trajectory and for said ground-resting ends to move downwardly towards to the ground in a second downward trajectory portion of said pseudo-parabolic trajectory.

40. The shelter as defined in claim 37, wherein said brace assemblies each define a first pivot joint pivotally attached to said marquee frame, and a second pivot joint pivotally attached to a spreader member, said spreader member movably engaging and being guided along said post to move said brace assemblies between said storage position and said deployed position.

41. The shelter as defined in claim 40, wherein each said brace assembly comprises:

a frame connecting brace defining a first end pivotally connected to said marquee frame and a second end opposite said first end;

a spreader brace defining a first end pivotally connected to said spreader member, and a second end opposite said first end, with said second end of said frame connecting brace being pivotally attached to said spreader member intermediate said spreader brace first and second ends;

a ground-resting brace having a first end destined to rest on the ground in said deployed position of said brace assembly and a second end opposite said first end, with said second end of said spreader brace being pivotally attached to said ground-resting brace intermediate said ground-resting brace first and second ends; and an intermediate brace having a first end pivotally connected to said frame connecting brace first and second ends, and a second end opposite said first end and pivotally connected to said ground-resting brace second end.

42. The shelter as defined in claim 40, wherein an actuator is provided on said shelter, which can be activated to forcibly drive said spreader member along said post.

43. The shelter as defined in claim 42, wherein said actuator comprises a hoisting system carried by said post, and a pushing member operatively connected to said hoisting system and slidably engaging said post; and wherein said spreader member is located intermediate said pushing member and said frame when said spreader member engages said post, and wherein upon activation of said hoisting system, said pushing member will be thereby driven along said post to slidably carry said spreader member.

44. The shelter as defined in claim 43, wherein when said spreader member engages said post, said spreader member is releasably coupled to said pushing member.

45. The shelter as defined in claim 44, wherein said spreader member comprises a spreader ring having at least one attachment aperture made thereon, and said pushing member comprises a push-ring pivotally carrying at least one attachment finger, wherein said attachment finger of said push-ring can be selectively pivoted to engage said attachment aperture of said spreader ring in order for said push-ring and said spreader ring to be releasably coupled.

46. The shelter as defined in claim 40, wherein when said brace assemblies are in said deployed position, said spreader member is releasably attached to said marquee frame and clears said post.

* * * * *